US008167031B2

(12) United States Patent
Jahnke

(10) Patent No.: US 8,167,031 B2
(45) **Date of Patent: *May 1, 2012**

(54) BLOWOUT PREVENTER WITH SHEARING BLADES

(75) Inventor: Douglas Jahnke, Houston, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/279,858

(22) Filed: Oct. 24, 2011

(65) Prior Publication Data

US 2012/0043068 A1 Feb. 23, 2012

Related U.S. Application Data

(63) Continuation of application No. 13/209,072, filed on Aug. 12, 2011.

(60) Provisional application No. 61/374,258, filed on Aug. 17, 2010, provisional application No. 61/475,533, filed on Apr. 14, 2011.

(51) Int. Cl.
*E21B 33/06* (2006.01)

(52) U.S. Cl. ..... 166/85.4; 251/1.1

(58) Field of Classification Search ..... 166/55, 166/298, 85.4; 251/1.1, 1.3; 83/51, 54, 693, 83/694

See application file for complete search history.

(56) References Cited

U.S. PATENT DOCUMENTS

| | | | | |
|---|---|---|---|---|
| 631,832 | A | 8/1899 | Thackray | |
| 897,984 | A | 9/1908 | Kruger | |
| 1,161,705 | A | 11/1915 | Lloyd | |
| 1,269,635 | A | 6/1918 | Neuman | |
| 1,800,005 | A | 4/1931 | Braun | |
| 2,090,206 | A * | 8/1937 | King | 277/325 |
| 2,236,833 | A | 4/1941 | Pell et al. | |
| 2,423,601 | A | 7/1947 | MacArthur | |
| 2,555,069 | A | 5/1951 | Verney | |
| 2,596,851 | A | 5/1952 | Hansen | |
| 2,620,030 | A | 12/1952 | Anderson | |
| 2,653,664 | A | 9/1953 | Dolby | |
| 2,678,097 | A | 5/1954 | Hahn et al. | |
| 2,741,309 | A | 4/1956 | Czarnik | |
| 2,776,003 | A | 1/1957 | Koster | |

(Continued)

FOREIGN PATENT DOCUMENTS

| | | |
|---|---|---|
| DE | 837036 | 6/1952 |

(Continued)

*Primary Examiner* — David Bagnell
*Assistant Examiner* — Ronald Runyan
(74) *Attorney, Agent, or Firm* — Locke Lord LLP

(57) ABSTRACT

The disclosure provides a blowout preventer (BOP) system with a ram having a shear blade with a shear blade profile to shear a tubular member disposed in the BOP. The shear blade profile can include a stress concentrator and centering shaped surface. The stress concentrator and the centering shaped surface can be laterally offset from a centerline of ram travel and on opposite sides of the centerline. An opposing second shear blade can have a mirror image of the shear blade profile with the stress concentrator and centering shaped surface reversed to the orientation of the first shear blade. Further, the ram can include a mandrel with a mandrel profile for the tubular member to deform around during the shearing process and to reduce an overall lateral width of the sheared tubular member in the BOP through-bore to allow retrieval of the deformed sheared tubular member from the BOP.

16 Claims, 20 Drawing Sheets

U.S. PATENT DOCUMENTS

| | | | | | |
|---|---|---|---|---|---|
| 2,884,063 | A | | 4/1959 | Stover | |
| 2,908,328 | A | | 10/1959 | Robertson | |
| 2,919,111 | A | | 12/1959 | Nicolson | |
| 2,947,508 | A | | 8/1960 | Allen | |
| 2,969,838 | A | | 1/1961 | Wilde | |
| 3,040,611 | A | | 6/1962 | Tournaire | |
| 3,065,657 | A | | 11/1962 | Thompson | |
| 3,097,556 | A | | 7/1963 | Mackey | |
| 3,125,108 | A | | 3/1964 | Murphy | |
| 3,129,624 | A | | 4/1964 | Auer | |
| 3,143,018 | A | | 8/1964 | Everett | |
| 3,145,462 | A | | 8/1964 | Bognar | |
| 3,304,819 | A | | 2/1967 | Pasternack | |
| 3,309,952 | A | | 3/1967 | Walsh | |
| 3,379,255 | A | | 4/1968 | Burns, Jr. et al. | |
| 3,399,559 | A | | 9/1968 | Mitchell | |
| 3,399,728 | A | | 9/1968 | Taylor | |
| 3,516,312 | A | | 6/1970 | Nordberg et al. | |
| 3,554,278 | A | | 1/1971 | Reistle, III et al. | |
| 3,561,526 | A | | 2/1971 | Williams, Jr. et al. | |
| 3,687,166 | A | | 8/1972 | Herrin | |
| 3,716,068 | A | | 2/1973 | Addison | |
| 3,736,982 | A | | 6/1973 | Vujasinovic | |
| 3,747,450 | A | | 7/1973 | Hudson | |
| 3,754,428 | A | | 8/1973 | Alexoff | |
| 3,766,979 | A | | 10/1973 | Petrick | |
| 3,817,326 | A | | 6/1974 | Meynier, III | |
| 3,863,667 | A | | 2/1975 | Ward | |
| 3,938,415 | A | | 2/1976 | Borzym | |
| 3,946,806 | A | | 3/1976 | Meynier, III | |
| 3,955,622 | A | | 5/1976 | Jones | |
| 4,015,496 | A | | 4/1977 | Hill | |
| 4,043,389 | A | | 8/1977 | Cobb | |
| 4,055,100 | A | | 10/1977 | Borzym | |
| 4,081,027 | A | * | 3/1978 | Nguyen | 116/55 |
| 4,108,029 | A | | 8/1978 | Borzym | |
| 4,132,265 | A | | 1/1979 | Williams, Jr. et al. | |
| 4,132,267 | A | | 1/1979 | Jones | |
| 4,215,749 | A | | 8/1980 | Dare et al. | |
| 4,313,496 | A | * | 2/1982 | Childs et al. | 166/55 |
| 4,337,680 | A | | 7/1982 | Borzym | |
| 4,341,264 | A | | 7/1982 | Cox et al. | |
| 4,347,898 | A | | 9/1982 | Jones | |
| 4,457,200 | A | | 7/1984 | Borzym | |
| 4,523,639 | A | | 6/1985 | Howard, Jr. | |
| 4,537,250 | A | | 8/1985 | Troxell, Jr. | |
| 4,549,349 | A | | 10/1985 | Harrison | |
| 4,563,927 | A | | 1/1986 | Kinsley | |
| 4,608,754 | A | | 9/1986 | Kloster | |
| 4,646,825 | A | | 3/1987 | Van Winkle | |
| 4,653,370 | A | | 3/1987 | Baudisch et al. | |
| 4,845,849 | A | | 7/1989 | Aubriot | |
| 5,013,005 | A | | 5/1991 | Nance | |
| 5,237,899 | A | | 8/1993 | Schartinger | |
| 5,360,061 | A | | 11/1994 | Womble | |
| 5,400,857 | A | | 3/1995 | Whitby et al. | |
| 5,515,916 | A | | 5/1996 | Haley | |
| 5,893,315 | A | | 4/1999 | Miller | |
| 5,967,012 | A | | 10/1999 | Dummer et al. | |
| 6,158,505 | A | | 12/2000 | Araujo | |
| 6,173,770 | B1 | | 1/2001 | Morrill | |
| 6,357,327 | B1 | | 3/2002 | Usui et al. | |
| 7,090,019 | B2 | | 8/2006 | Barrow et al. | |
| 7,367,396 | B2 | | 5/2008 | Springett et al. | |
| 7,814,979 | B2 | | 10/2010 | Springett et al. | |
| 2011/0000670 | A1 | | 1/2011 | Springett et al. | |

FOREIGN PATENT DOCUMENTS

| | | |
|---|---|---|
| DE | 2524206 | 12/1976 |
| EP | 0 220 138 | 4/1987 |
| EP | 0 305 341 | 3/1989 |
| EP | 0 872 294 | 10/1998 |
| FR | 1287015 | 3/1962 |
| FR | 2761283 | 10/1998 |
| GB | 139272 | 3/1920 |
| JP | 51040679 | 4/1976 |
| JP | 52001688 | 1/1977 |
| JP | 52057582 | 5/1977 |
| JP | 52154191 | 12/1977 |
| JP | 53015683 | 2/1978 |
| JP | 56003128 | 1/1981 |
| JP | 56089423 | 7/1981 |
| JP | 60-150905 | 8/1985 |
| JP | 63-185511 | 8/1988 |
| JP | 1058412 | 3/1989 |
| WO | 2006/014895 | 2/2006 |

* cited by examiner

BLOWOUT PREVENTER WITH SHEARING BLADES

CROSS REFERENCE TO RELATED APPLICATIONS

This application is a continuation of U.S. application Ser. No. 13/209,072, filed on Aug. 12, 2011, which claims the benefit of U.S. Provisional Application No. 61/374,258, filed on Aug. 17, 2010, and U.S. Provisional Application No. 61/475,533 filed on Apr. 14, 2011.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates oil field equipment. More particularly, the disclosure relates to the blowout preventers.

2. Description of the Related Art

In gas and oil wells, it is sometimes necessary to shear a tubular member disposed therein and seal the wellbore to prevent an explosion or other mishap from subsurface pressures. Typically, the oil field equipment performing such a function is known as a blowout preventer ("BOP"). A BOP has a body that typically is mounted above a well as equipment in a BOP stack.

A typical BOP has a body with a through-bore through which a drill pipe or other tubular member can extend. A pair of rams extend at some non-parallel angle (generally perpendicular) to the through-bore from opposite sides of the bore. The rams are able to move axially within guideways at the non-parallel angle to the bore. A pair of actuators connected to the body at the outer ends of the rams cause the rams to move along the guideway, and close around or shear the drill pipe disposed therebetween. Different types of blades can be coupled with the rams depending on the style of the blowout preventer, and typically include "pipe," blind, or shear blades. A ram with a blade has one or more sealing surfaces that seal against an object, including an opposing ram. For example, shear blades are typically at slightly different elevations, so that one shear blade passes slightly below the other shear blade to cause the shearing action of a pipe or object disposed between the rams. After the shearing, sealing surfaces on the rams can seal against each other, so that the pressure in the well is contained and prevented from escaping external to the well bore.

In typical BOPs, the shear blades typically are "V-shaped" that contact outer perimeter points of a tubular member disposed in a through-bore opening of the BOP, deforming the tubular member between the opposing V-shaped blades, and shearing the tubular members starting at the lateral outside edges between the V-shaped blades. Typically, the shear blades do not extend to the outer perimeter of the BOP through-bore. The outer perimeter is reserved for sealing members and the structure required to support the sealing members to contain the well bore pressures. Thus, if a tubular member is off-center in the through-bore, the shear blades may bypass the tubular member, and not shear the tubular member. Further, the bypassed member can become lodged between the shear blades and damage or at least block further movement of the shear blades.

A further challenge in typical BOPs is the ability to retrieve the sheared tubular member also termed a "fish." The fish is created by deforming the tubular member into a substantially flattened shape initially between the shearing blades, and then shearing the tubular member with the BOP. The perimeter of the flattened fish is equal to the perimeter of the prior tubular member. However, the width of the flattened fish across the BOP is wider than the prior diameter of the tubular member, because the flattened fish is smaller in depth compared to the prior diameter. Sometimes, the fish can be difficult to retrieve or can become stuck in the attempt to retrieve.

Therefore, there remains a need for improved blowout preventer to center and shear tubular members disposed therethrough.

BRIEF SUMMARY OF THE INVENTION

The disclosure provides a blowout preventer (BOP) system with a ram having a shear blade with a shear blade profile to shear a tubular member disposed in the BOP through-bore. The shear blade profile can include one or more stress concentrators and a centering shaped surface that in some embodiments is asymmetric relative to a centerline of a guideway in the BOP along which the rams close and open around the through-bore. The stress concentrator and the centering shaped surface can be laterally offset from a centerline of the ram travel along the guideway and on opposite sides of the centerline. The profile on one shearing blade can be different from the opposing shearing blade profile. Further, the shearing blade profile can be curved with one or more large radii. The centering shaped surface can extend longitudinally further into the through-bore than the stress concentrator. In at least one embodiment, a first shear blade coupled to a first ram has the shear blade profile, and an opposing second shear blade coupled to an opposing second ram has a mirror image of the shear blade profile with the stress concentrator and centering shaped surface reversed to the orientation of the first shear blade relative to the centerline of the ram travel. Further, the ram can include a mandrel with a mandrel profile that extends into the through-bore at a different elevation than the shear blade profile. The mandrel profile receives an opposing portion of the tubular member from the opposing shear blade. The mandrel profile provides a surface for the tubular member to deform around and reduce an overall lateral width of the separated tubular member in the BOP through-bore to allow retrieval of the deformed separated tubular member from the BOP.

DETAILED DESCRIPTION

Figure 1A:
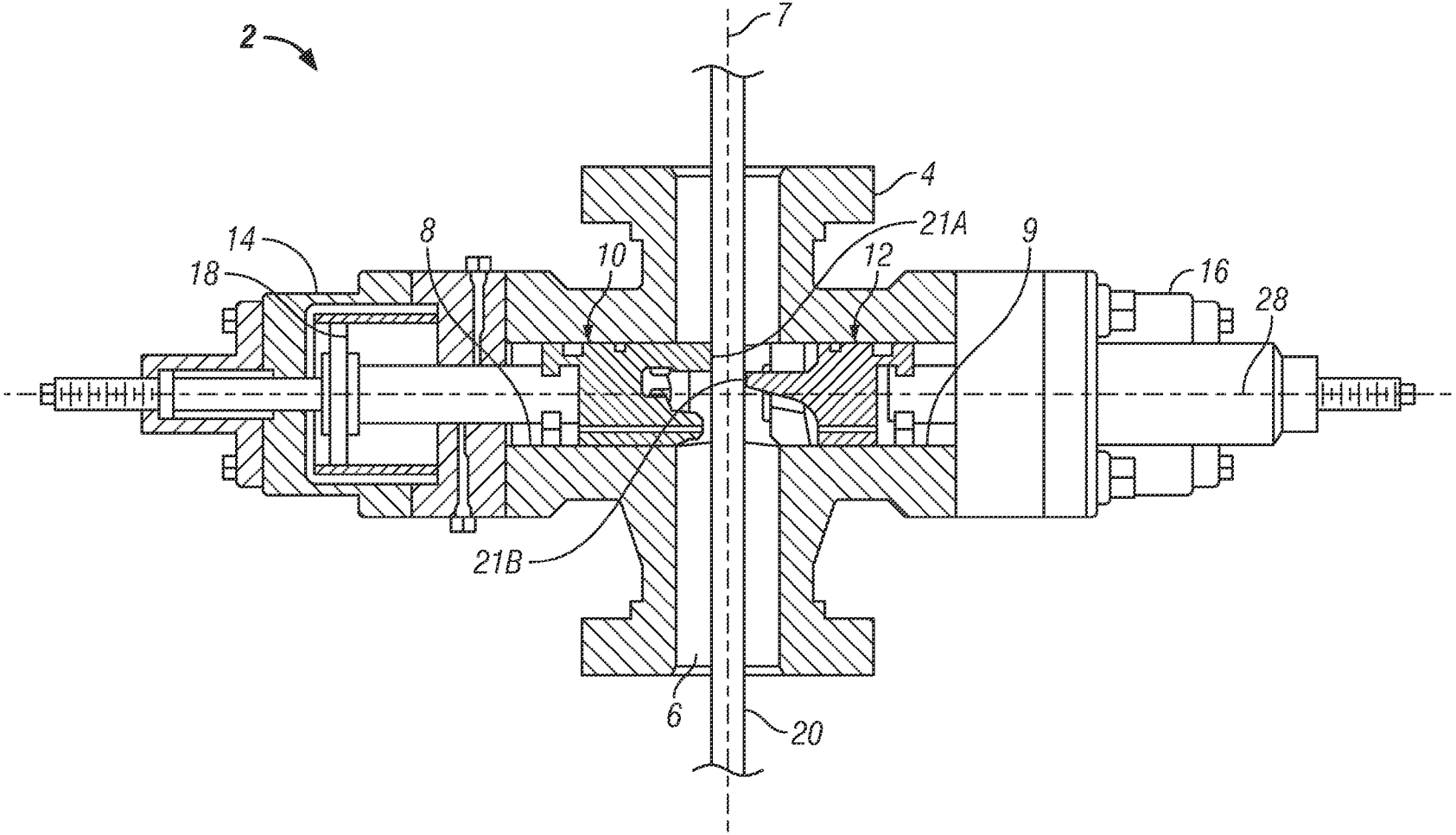
FIG. 1A is a cross-sectional schematic view of a blowout preventer having one or more actuators with rams coupled thereto.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Some numbered elements herein are described with "A" and "B" suffixes to designate corresponding parts of the same or similar element when appropriate, and such elements can be generally referenced herein as the number without the suffix.

The disclosure provides a blowout preventer (BOP) system with a ram having a shear blade with a shear blade profile to shear a tubular member disposed in the BOP through-bore. The shear blade profile can include one or more stress concentrators and a centering shaped surface that in some embodiments is asymmetric relative to a centerline of a guideway in the BOP along which the rams close and open around the through-bore. The stress concentrator and the centering shaped surface can be laterally offset from a centerline of the ram travel along the guideway and on opposite sides of the centerline. The profile on one shearing blade can be different from the opposing shearing blade profile. Further, the shearing blade profile can be curved with one or more large radii. The centering shaped surface can extend longitudinally further into the through-bore than the stress concentrator. In at least one embodiment, a first shear blade coupled to a first ram has the shear blade profile, and an opposing second shear blade coupled to an opposing second ram has a mirror image of the shear blade profile with the stress concentrator and centering shaped surface reversed to the orientation of the first shear blade relative to the centerline of the ram travel. Further, the ram can include a mandrel with a mandrel profile that extends into the through-bore at a different elevation than the shear blade profile. The mandrel profile receives an opposing portion of the tubular member from the opposing shear blade. The mandrel profile provides a surface for the tubular member to deform around and reduce an overall lateral width of the separated tubular member in the BOP through-bore to allow retrieval of the deformed separated tubular member from the BOP.

FIG. 1A is a cross-sectional schematic view of a blowout preventer having one or more actuators with rams coupled thereto. The illustrated blowout preventer ("BOP") is a shearing BOP. The BOP 2 includes a blowout preventer body 4 having a through-bore 6 defining a centerline 7. The through-bore 6 is sized sufficiently to allow a tubular member 20 to be placed through the opening 6 generally aligned with the centerline 7.

The BOP 2 further includes a first ram 10 disposed to travel in a first guideway 8. The first guideway 8 is disposed along a guideway centerline 28 for the ram to travel at a non-parallel angle to the centerline 7 of the through-bore 6, generally at a right angle. The ram 10 can move in the guideway 8 to close toward the through-bore 6 and open away from the through-bore, that is, left and right the view of the FIG. 1A. Similarly, a second ram 12 is disposed in a second guideway 9 along the guideway centerline 28 at a non-parallel angle to the through-bore centerline 7. The first ram 10 is actuated by a first actuator 14. The first actuator 14 can be electrically, hydraulically, pneumatically, or otherwise operated. In the example shown, an actuator piston 18 is displaced by incoming pressurized fluid to move the first ram 10 along the guideway centerline 28 to engage the tubular member 20. Similarly, the second ram 12 can be actuated by a second actuator 16 to move the second ram 12 toward the centerline 7. The first ram 10 and the second ram 12 engage the side of tubular member 20, compress the cross-section of the tubular member as the rams progress toward the centerline 7, and ultimately separate the tubular member into at least two pieces as the rams slide by each other, where one piece is above the rams and one piece is below the rams. Generally, the rams 10, 12 include shear blades 21A, 21B (collectively "21") disposed at a leading edge of the rams to separate the tubular member 20. Details of various shapes of shear blades are described in the other figures. The rams 10, 12 can open by retracting the rams away from the through-bore 6.

Figure 1B:
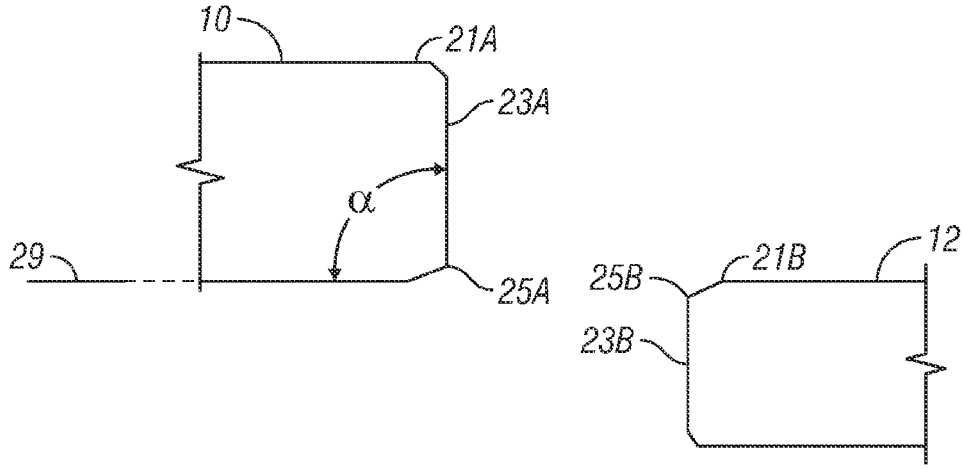
FIG. 1B is a detail side cross-sectional schematic view of a shear blade with an exemplary shear blade face in the blowout preventer of FIG. 1A.

FIG. 1B is a detail side cross-sectional schematic view of a shear blade with an exemplary shear blade face in the blowout preventer of FIG. 1A. The ram 10 is coupled with a shear blade 21A, and the ram 12 is coupled with a shear blade 21B. The rams 10 and 12 are actuated toward each other and define a shear plane 29 that coincides with their respective direction of travel. The shear blades 21 can be the same or different from each other, as described herein. The shear blades define a shear face, so that the shear blade 21A defines a shear face 23A, and the shear blade 21B defines a shear face 23B (generally "23"). The shear faces 23A, 23B include shear edges 25A, 25B (generally "25"), respectively, that generally have a small chamfer to better allow the shear blades to engage each other and slide over each other in operation.

A standard conventional shear face 23 is tapered away at a rake angle "a" from the leading shear edge 25. The purpose is to shear the tubular member. Thus, a standard conventional profile is formed with about a 15 degree rake angle that is tapered away from the centerline 7 shown in FIG. 1A, to act as a knife edge is propagating the shearing.

Unexpectedly, the inventor discovered that rather than a sharp edge created by the rake angle $\alpha$, the invention performs better with a blunt face, that is, a substantially perpendicular rake angle for the shear face. It is believed, without limitation, that the blunt face, perhaps in combination with other features herein, causes the tubular member to tear by exceeding an ultimate tensile strength, as well as shear strength. However, regardless of the reason(s), the inventor has discovered that the substantially perpendicular shear face advantageously performs in the BOP described herein. The term "perpendicular" is intended to mean substantially at a right angle $\alpha$ to the shear plane 29. Generally, the shear plane 29 is parallel with the guideway centerline 28, because the rams 10, 12 move parallel to the centerline 28 as they engage the tubular member 20. For purposes herein, the term "perpendicular" can vary by a tolerance of 10 degrees either way, plus or minus, and any angle or portion of an angle therebetween, from a right angle to the shear plane 29.

Figure 1C:
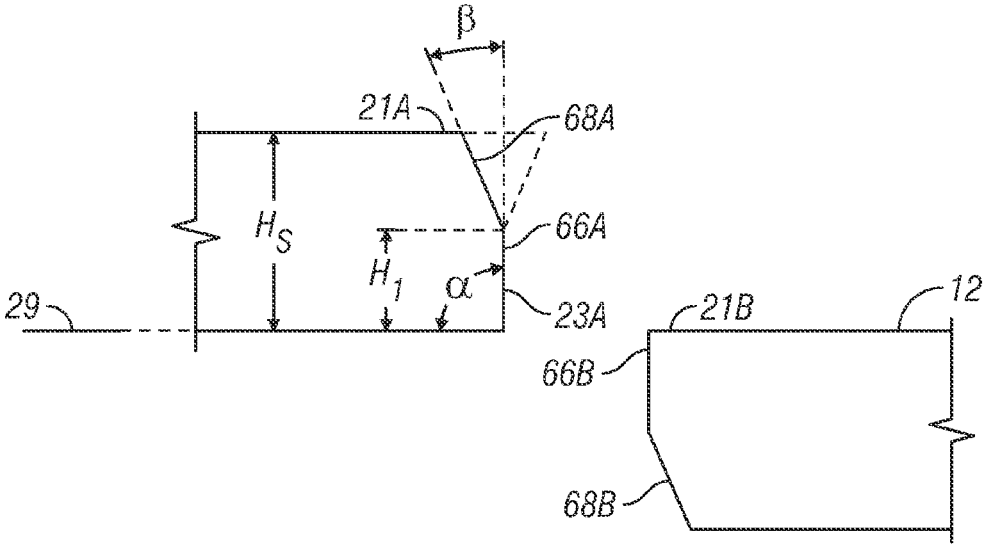
FIG. 1C is a detail side cross-sectional schematic view of a shear blade with an alternative exemplary shear blade face in the blowout preventer of FIG. 1A.

FIG. 1C is a detail side cross-sectional schematic view of a shear blade with an alternative exemplary shear blade face in the blowout preventer of FIG. 1A. In view of the desirable perpendicular shear face 23, the inventor has also recognized that the length of the perpendicular portion of the shear face can vary with a minimum height of 50% of the typical height "$H_S$" of the shear blade 21. Thus, in the embodiment shown in FIG. 10, the shear face 23A can include a first portion 66A that is perpendicular to the shear plane 29 and has a height $H_1$ that is at least 50% of the height $H_S$ of the shear blade 21A. A second portion 68A distal from the shear plane 29 can vary from the perpendicular angle $\alpha$ by some plus or minus angle $\beta$. The shear blade 21B can differ from the shear blade 21A. For example, the shear blade 21A in FIG. 1B could be used with the shear blade 21B of FIG. 10, and other examples could vary. However, for illustrative purposes in FIG. 10, the shear blade 21B also includes a first portion 66B that is substantially perpendicular and a second portion 68B that varies at some angle from the first portion 66B.

Figure 2:
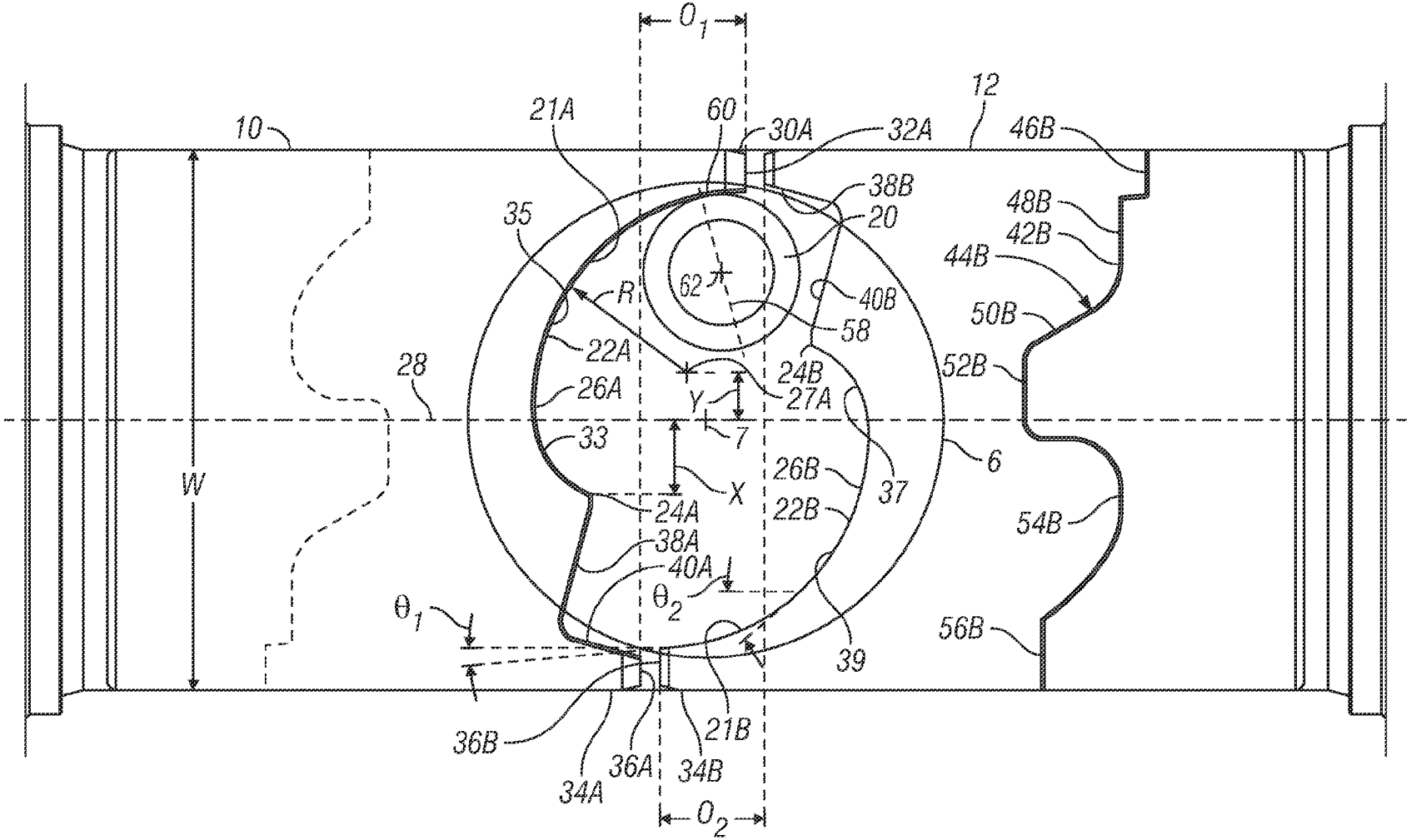
FIG. 2 is a schematic top cross-sectional view of a portion of the BOP in FIG. 1A, illustrating the BOP through-bore with a tubular element and rams with a shear blade having a shear blade profile and a mandrel having a mandrel profile.

FIG. 2 is a schematic top cross-sectional view of a portion of the BOP in FIG. 1A, illustrating the BOP through-bore with a tubular element and rams with a shear blade having a shear blade profile and a mandrel having a mandrel profile. The rams generally have a width "W" that fits within the guideways of the BOP. The first ram 10 includes a shear blade 21A having an overall shear blade profile 22A. The shear blade operates to shear a tubular member 20 disposed in the BOP through-bore 6. In at least one embodiment, the shear blade profile 22A includes at least one stress concentrator 24A and at least one centering shaped surface 26A. The guideway centerline 28 indicates a longitudinal line of movement of the rams as they open and close in the BOP and generally passes through the vertical centerline 7 of the through-bore 6. The term "centering" is meant to include the tendency of the shear blade profile to push a tubular member in the through-bore toward the guideway centerline 28 and advantageously toward the centerline 7 of the through-bore 6. Some elements are described herein as being lateral or disposed laterally to indicate a direction that is at an angle to the guideway centerline 28 across the guideway.

The first ram 10 includes a containment arm 30A adjacent the centering shaped surface 26A, the containment arm 30A having an end 32A. The first ram 10 further includes a second containment arm 34A on an opposite side of the centerline 28 from the containment arm 30A and adjacent the stress concentrator 24A, the second containment arm 34A having an end 36A. The containment arms 30A, 34A are disposed laterally outward from the guideway centerline 28 toward the edges of the ram 10. A first shaping surface 38A is disposed inward toward the centerline 28 from the second containment arm 34A, and a second shaping surface 40A is disposed inward from the first shaping surface and adjacent the stress concentrator 24A. The stress concentrator is disposed a distance "X" laterally from the centerline 28. The centering shaped surface 26A has a majority of the shaped surface disposed on an opposite side laterally of the centerline 28 from the stress concentrator 24A. If the centering shaped surface 26A is a curved surface having a radius R, then in at least one embodiment, a center point 27A of the curved surface can be on the opposite side of the centerline 28 from the stress concentrator 26A by a distance "Y" from the centerline. The radius R can be any size suitable for the purposes of the shear blade and in at least one embodiment can be at least 20% of the width "W" of the ram, and further at least 25% of the width of the ram.

The exemplary shear blade profile 22A shown in FIG. 2 is asymmetric relative to the centerline 28. For purposes of description relative to the asymmetry, the shear blade profile 22A includes a first portion 33 on one side of the centerline 28 and a second portion 35 on the other side of the centerline lateral opposite the first portion. In the embodiment shown, the first portion 33 includes the stress concentrator 24A, the first shaping surface 38A, the second shaping surface 40A, and a portion of the centering shaped surface 26A. The second portion 35 includes the remainder of the centering shaped surface 26A. Thus, relative to the centerline 28, the portions 33, 35 are asymmetric in shape to each other relative to the centerline 28.

The second ram 12 can have a shear blade 21B with a shear blade profile 22B. In at least one embodiment, the shear blade profile 22B is a mirror image of the shear blade profile 22A, reversed to the orientation of the first shear blade 21A and its shear blade profile 22B relative to the centerline 28. Thus, the shear blade profile 22B includes at least one stress concentrator 24B and a centering shaped surface 26B, containment arms 30B, 34B with ends 32B, 36B, respectively, and shaping surfaces 38B, 40B.

While not limited to such, the exemplary shear blade profile 22B shown in FIG. 2 is asymmetric relative to the centerline 28 as well. For purposes of description relative to the asymmetry, the shear blade profile 22B includes a first portion 37 on one side of the centerline 28 and a second portion 39 on the other side of the centerline, laterally opposite of the centerline 28 from the first portion. In the embodiment shown, the first portion 37 includes the stress concentrator 24B, the first shaping surface 38B, the second shaping surface 40B, and a portion of the centering shaped surface 26B. The second portion 39 includes the remainder of the centering shaped surface 26B. Thus, relative to the centerline 28, the portions 37, 39 are asymmetric in shape relative to the centerline 28.

Traditionally, symmetrical V-shaped shear blades have been used. The inventor has found that such symmetrical V-shaped shear blades are less effective or non-effective at centering the tubular member 20 toward the centerline 7 in the through-bore of the BOP, shown in FIG. 1A.

The centering shaped surface 26 can be shaped to move the tubular member toward the centerline 7. In at least one embodiment, at least one of the shear blades 21 can be curved. Further, the shaped surface 26 can include a relatively gradually shaped surface at an initial engagement angle $\theta_1$ relative to the centerline 28 near an outside portion of the shear blade that is distal from the centerline 28. The engagement angle progressively increases in size (for example, the engagement angle $\theta_2$) as the shaped surface progresses toward the centerline 28. At least one curve of the shaped surface 26 can have a radius R of at least 20% of the width W of the respective ram to which the shear blade is coupled.

Further, the containment arms in the exemplary embodiment shown in at least FIG. 2 can be longitudinally offset along the guideway centerline 28 from each other by an offset distance "O." The offset can assist in providing the initial small engagement angle distal from the centerline 28 on at least one of the containment arms. For example, the containment arms 30A, 34A of the ram 10 are offset from each other by the offset distance "$O_1$". The centering shaped surface 26A intersects the longer containment arm 30A that is offset from the containment arm 34A and provides a relatively initial small engagement angle $\theta_1$. The containment arms 30B, 34B can be offset by an offset distance $O_2$. If containment arms on the ram 12 correspond to the containment arms on the ram 10, then the containment arms 30B, 34B can be also offset by the same offset distance.

The rams can further include a mandrel. As shown in FIG. 2 with respect to the ram 12, the mandrel 42B can include a mandrel profile 44B with the understanding that a similar mandrel and mandrel profile can be described for the ram 10. The mandrel receives an opposing portion of the tubular member from the opposing shear blade. The mandrel profile provides a surface for the tubular member to deform around and reduce an overall lateral width of the sheared tubular member in the BOP through-bore to allow retrieval of the deformed sheared tubular member from the BOP.

The mandrel profile 44B can include, for example, a receiver 46 by which the containment arm 30A with its end 32A passes. The mandrel profile 44B can further include a lead mandrel portion 48B with a sloping surface 50B toward the receiver side of the mandrel profile, and a recess mandrel portion 54B on the distal side of the lead mandrel portion from the receiver. An end mandrel portion 56B can be formed adjacent the recess mandrel portion 54B, by which the containment arm 34A with its end 36A passes.

A tubular member 20 is shown disposed off-center from the centerline 28 of the ram travel. A line 58 drawn from the contact point 60 between the tubular member 20 and the centering shaped surface 26A through the centerline 62 of the tubular member 20 shows that the line 58 is directed towards the center 7 of the through-bore 6 and would not intersect the second shaping surface 40B or the stress concentrator 24B.

Having described the elements of the rams with their shear blades and shear blade profiles, the following FIGS. 3-6 generally show various stages of operation of the BOP with its rams to center, shear, and deform a tubular member in the through-bore of the BOP, in at least one embodiment.

Figure 3:
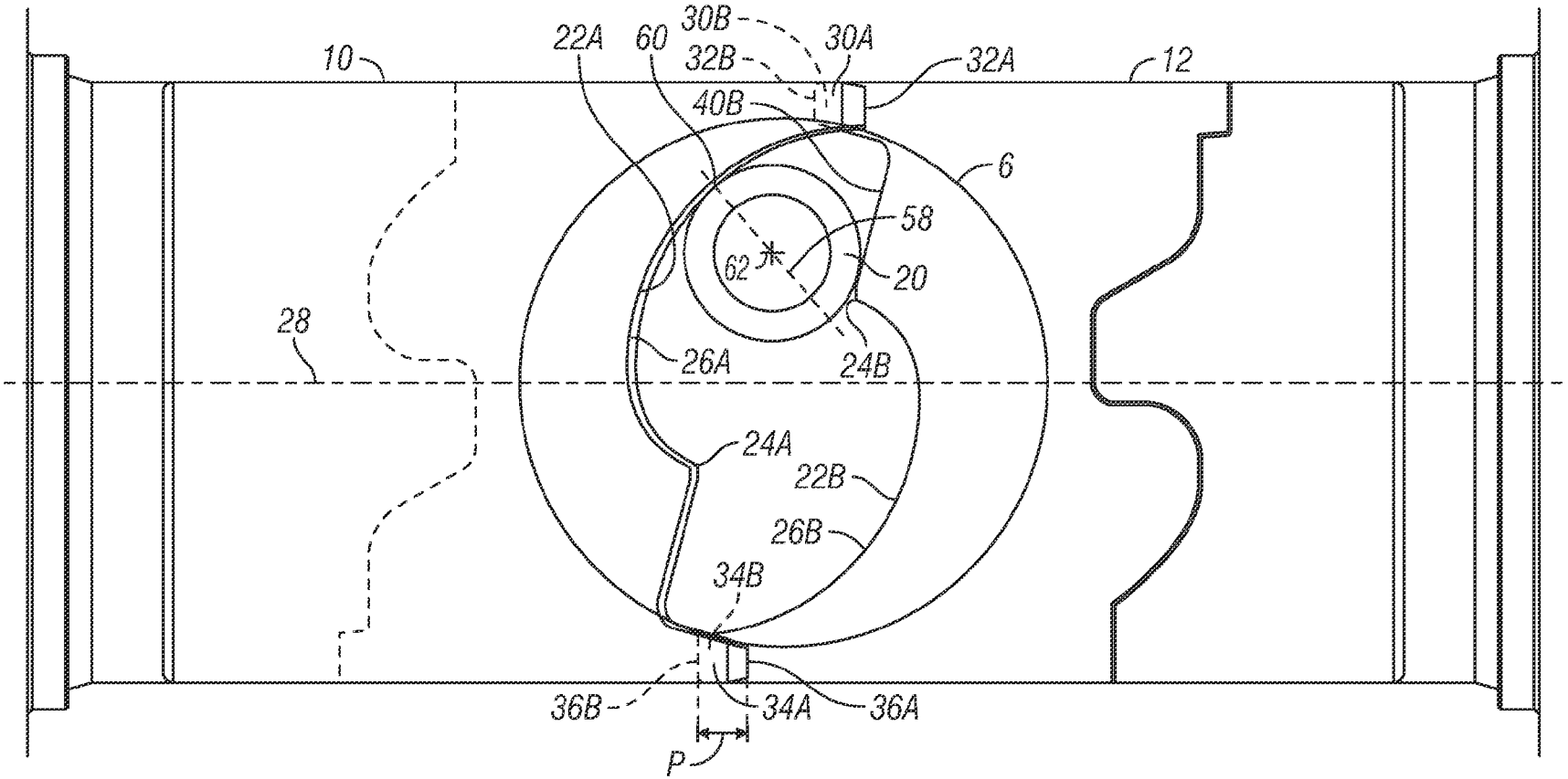
FIG. 3 is a schematic top cross-sectional view of a portion of the BOP in FIG. 1A, illustrating the rams closing and centering the tubular member with the shear blade profiles.

FIG. 3 is a schematic top cross-sectional view of a portion of the BOP in FIG. 1A, illustrating the rams closing and centering the tubular member with the shear blade profiles. As the rams 10, 12 close, the shear blade profile 22A with the centering shaped surface 26A pushes the tubular member 20 inward toward the centerline 28. At some time, the shear blade profile 22B is closed sufficiently to engage the tubular member 20. Thus, the tubular member 20 is contacted by the centering shaped surface 26A on the first shear blade 21A and the second shaping surface 40B on the second shear blade 21B. However, the geometry of the surfaces allows further closing of the rams 10, 12 to push the tubular member 20 further toward the centerline 28 and more toward the center of the BOP through-bore 6. For example and without limitation, the geometry between the surfaces allows the line 58 between the contact point 60 of the tubular member 20 with the surface 26A through the center 62 of the tubular member to point toward the centerline 28 without intersecting the shaping surface 40B.

Further, at some time during the closing of the rams 10, 12, the opposing containment arms can overlap at a distance "P". For example, the containment arm 34A of the ram 10 is shown overlapping with the containment arm 34B of the ram 12. The overlap is to assist in maintaining alignment of the rams in the separation of the tubular member 20 along the centerline 7 (vertical when viewed from the schematic diagram in FIG. 1A). The overlap distance P will generally be negative when the opposing containment arms are fully retracted (that is, not overlapping) and progressively become positive as the rams approach and then overlap each other. Generally, the overlap can be designed to occur prior to the start of separating the tubular member 20 into separate pieces. More specifically, the overlap distance P can be designed to occur prior to exceeding the shear strength of the tubular member, the ultimate tensile strength of the tubular member, or a combination thereof. In some cases, depending on the size of the tubular member, deforming the tubular member by exceeding a yield strength of the tubular member material may occur prior to the overlap.

Figure 4:
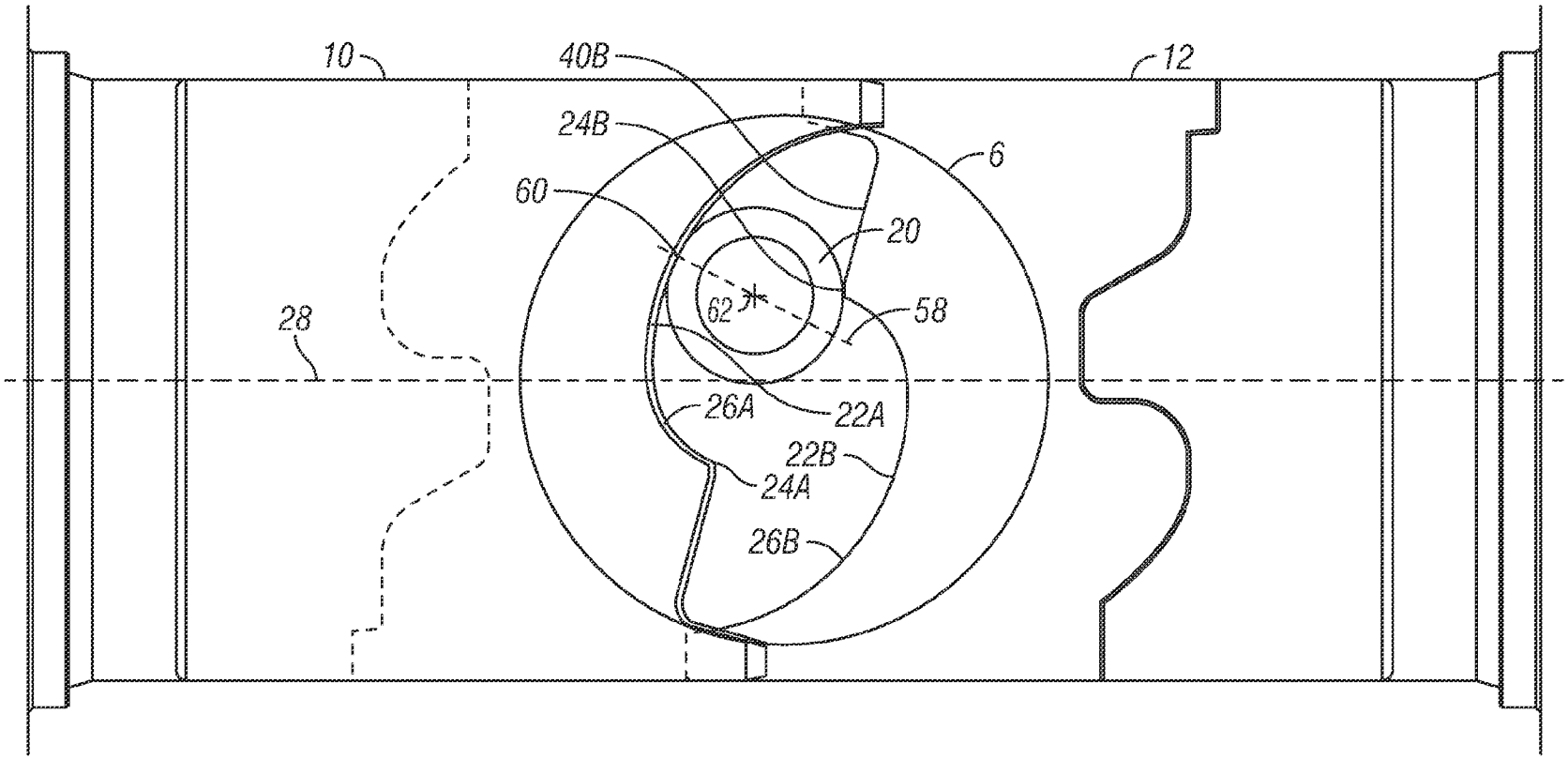
FIG. 4 is a schematic top cross-sectional view of a portion of the BOP in FIG. 1A, illustrating the rams closing and further centering the tubular member with the shear blade profiles.

FIG. 4 is a schematic top cross-sectional view of a portion of the BOP in FIG. 1A, illustrating the rams closing and further centering the tubular member with the shear blade profiles. As the rams 10, 12 continue to close, the shear blade profile 22A with the centering shaped surface 26A continues to push the tubular member 20 inward toward the centerline 28 and the center of the BOP through-bore 6. The geometry of the surfaces continues to allow further closing of the rams 10, 12 to push the tubular member 20 further toward the centerline 28. The line 58 between the contact point 60 of the tubular member 20 with the surface 26A through the center 62 of the tubular member continues to point toward the centerline 28 without intersecting the shaping surface 40B. Thus, the surface 26A, and specifically the progressively moving contact point 60 to the tubular member, can continue to exert a force on the tubular member 20 toward the centerline 28 without becoming entrapped by the shaping surface 40B.

Figure 5:
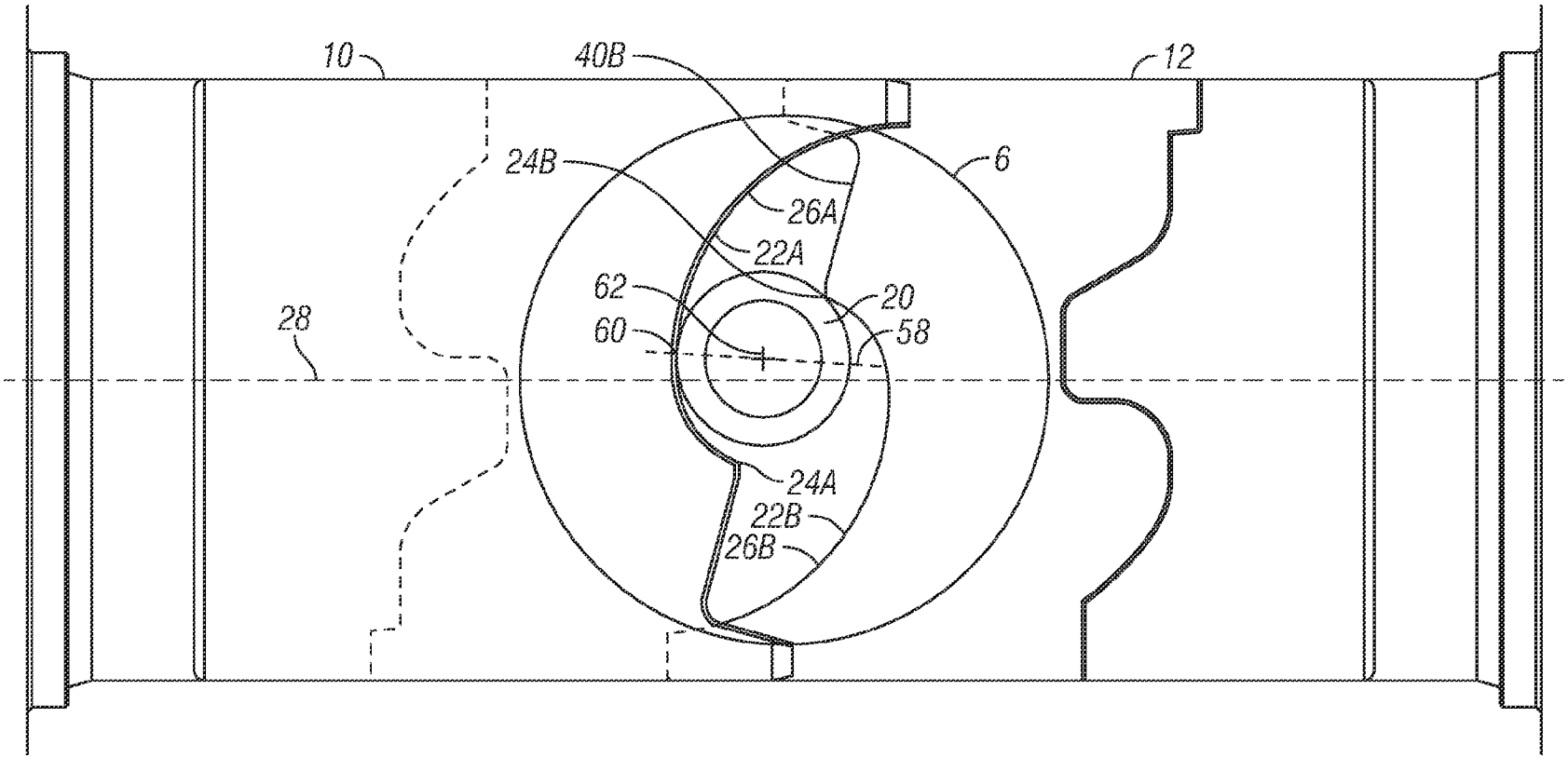
FIG. 5 is a schematic top cross-sectional view of a portion of the BOP in FIG. 1A, illustrating the rams closing and further centering the tubular member with the shear blade profiles.

FIG. 5 is a schematic top cross-sectional view of a portion of the BOP in FIG. 1A, illustrating the rams closing and further centering the tubular member with the shear blade profiles. As the rams 10, 12 continue to close, the shear blade profile 22A with the centering shaped surface 26A pushes the tubular member 20 over the stress concentrator 24B relative to the centerline 28, and toward the center of the BOP through-bore 6. The geometry of the surfaces continues to allow the line 58 between the contact point 60 of the tubular member 20 with the surface 26A through the center 62 of the tubular member to not intersect the shaping surface 40B.

Figure 6:
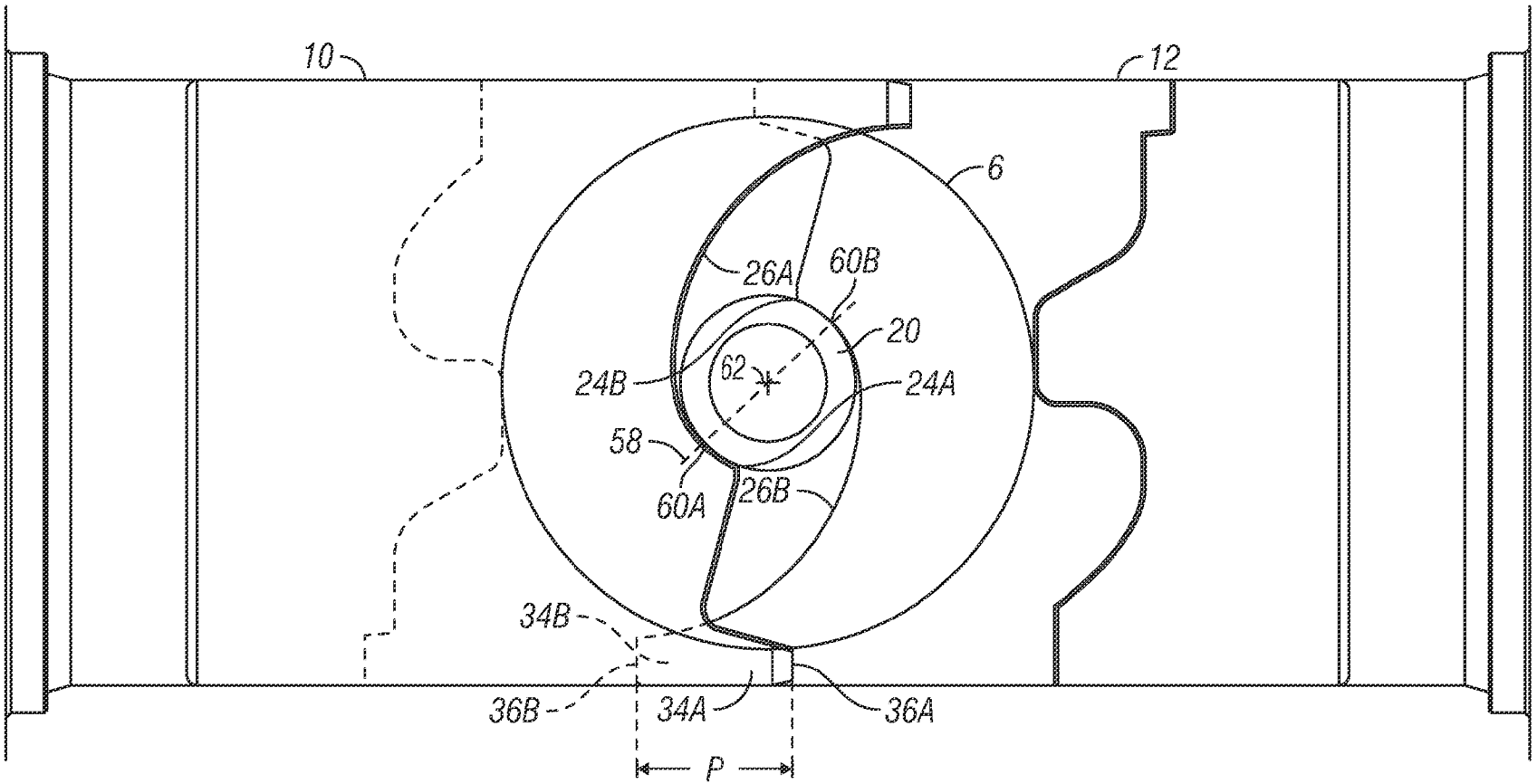
FIG. 6 is a schematic top cross-sectional view of a portion of the BOP in FIG. 1A, illustrating the rams closing and the tubular member centered between the shear blade profiles.

FIG. 6 is a schematic top cross-sectional view of a portion of the BOP in FIG. 1A, illustrating the rams closing and the tubular member centered between the shear blade profiles. As the rams 10, 12 continue to close, the centering shaped surface 26A pushes the tubular member 20 into contact with the opposing centering shaped surface 26B. Thus, the tubular member is entrapped between the centering shaped surfaces 26A, 26B, establishing two opposing contact points 60A, 60B, respectively, for the tubular member to the centering shaped surfaces. The line 58 between the contact points 60A, 60B passes through the center 62 of the tubular member and the tubular member is fixed in a stable position and generally in the center of the BOP through-bore 6. Further, the overlap distance P of the containment arms has increased relative to the overlap distance P shown in FIG. 3.

Although not shown, it is understood that further closing of the rams with the shear blades can deform and separate the tubular member 20 by exceeding the shear strength, ultimate tensile strength, or a combination thereof. The deformation and subsequent separation of the tubular member results in a flattened "fish". Because the tubular member 20 in this example is small relative to the BOP through-bore 6, the risk of being unable to retrieve the fish through the through-bore is relatively small.

A larger tubular member and features of the system and method described herein are illustrated in FIGS. 7-13.

Figure 7:
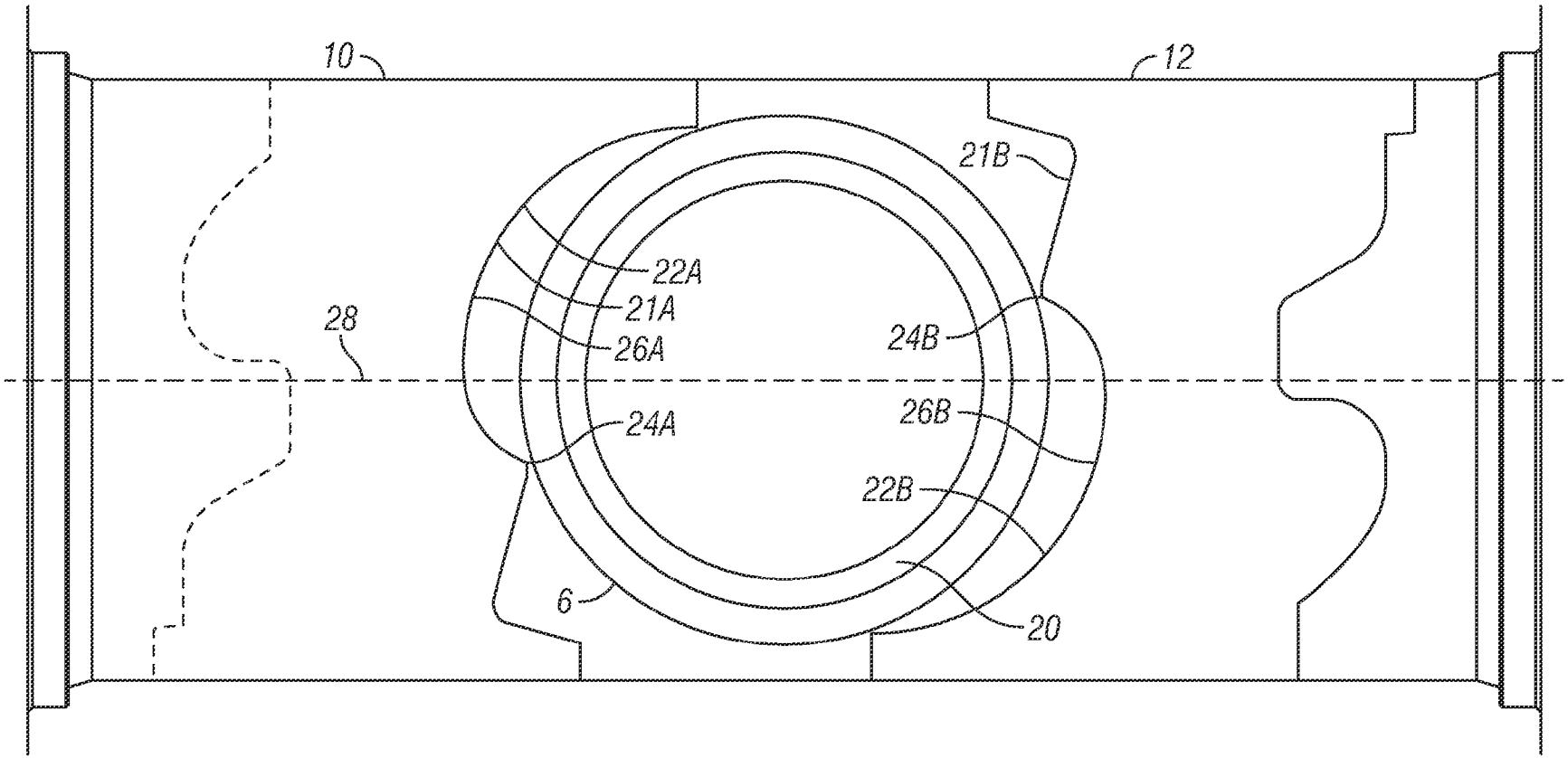
FIG. 7 is a schematic top cross-sectional view of a portion of the BOP in FIG. 1A, illustrating the BOP through-bore with a large tubular element and rams with a shear blade having a shear blade profile.

FIG. 7 is a schematic top cross-sectional view of a portion of the BOP in FIG. 1A, illustrating the BOP through-bore with a large tubular element and rams with a shear blade having a shear blade profile. The principles stated above for FIGS. 2-6 generally apply to other sizes of tubular members. The tubular member 20 shown in FIGS. 7-13 illustrates a larger tubular member 20 compared with the tubular member illustrated in FIGS. 2-6. The larger tubular member 20 can still be centered in the closing process, but will normally have less movement to the center and will be engaged by the stress concentrators differently than in the smaller tubular members. As described above, the rams 10, 12 have shear blades 21A, 21B with shear blade profiles 22A, 22B. The shear blade profile 22 has at least one stress concentrator 24 and at least one centering shaped surface 26. The stress concentrator 24 is generally disposed on an opposite side laterally of the centerline 28 from the centering shaped surface 26 for each ram.

Figure 8:
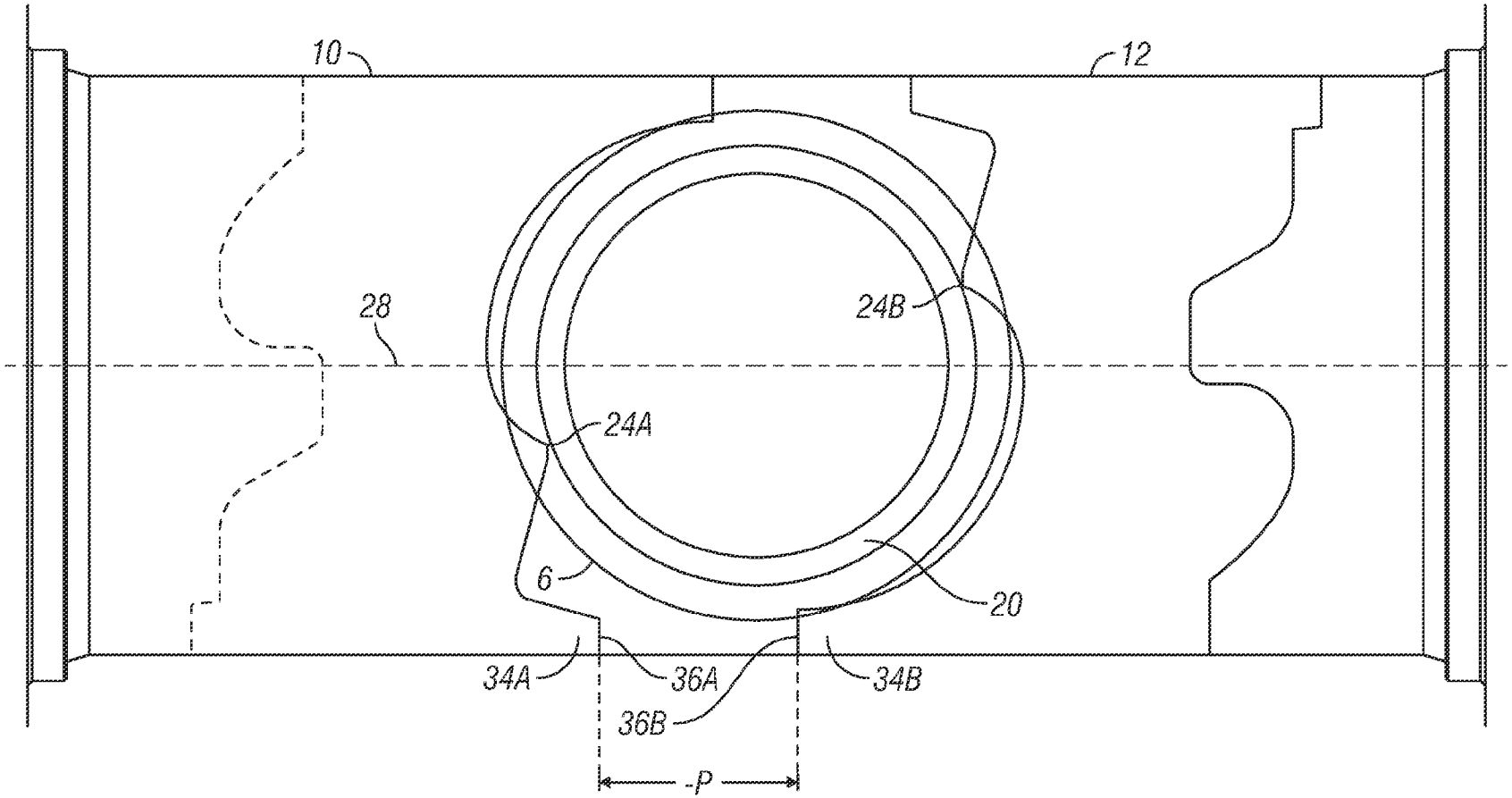
FIG. 8 is a schematic top cross-sectional view of a portion of the BOP in FIG. 1A, illustrating the rams closing.

FIG. 8 is a schematic top cross-sectional view of a portion of the BOP in FIG. 1A, illustrating the rams closing. As the rams close, the stress concentrators 24A, 24B can contact the tubular member 20. The contact with the stress concentrators 24A, 24B on opposing sides of the centerline 28 push the tubular member 20 toward a center of the BOP through-bore 6. Due to the size of the tubular member 20 in the through-bore 6, the containment arms 34A, 34B do not overlap each other at this time in the process. Thus, the overlap distance P is a negative value.

Figure 9:
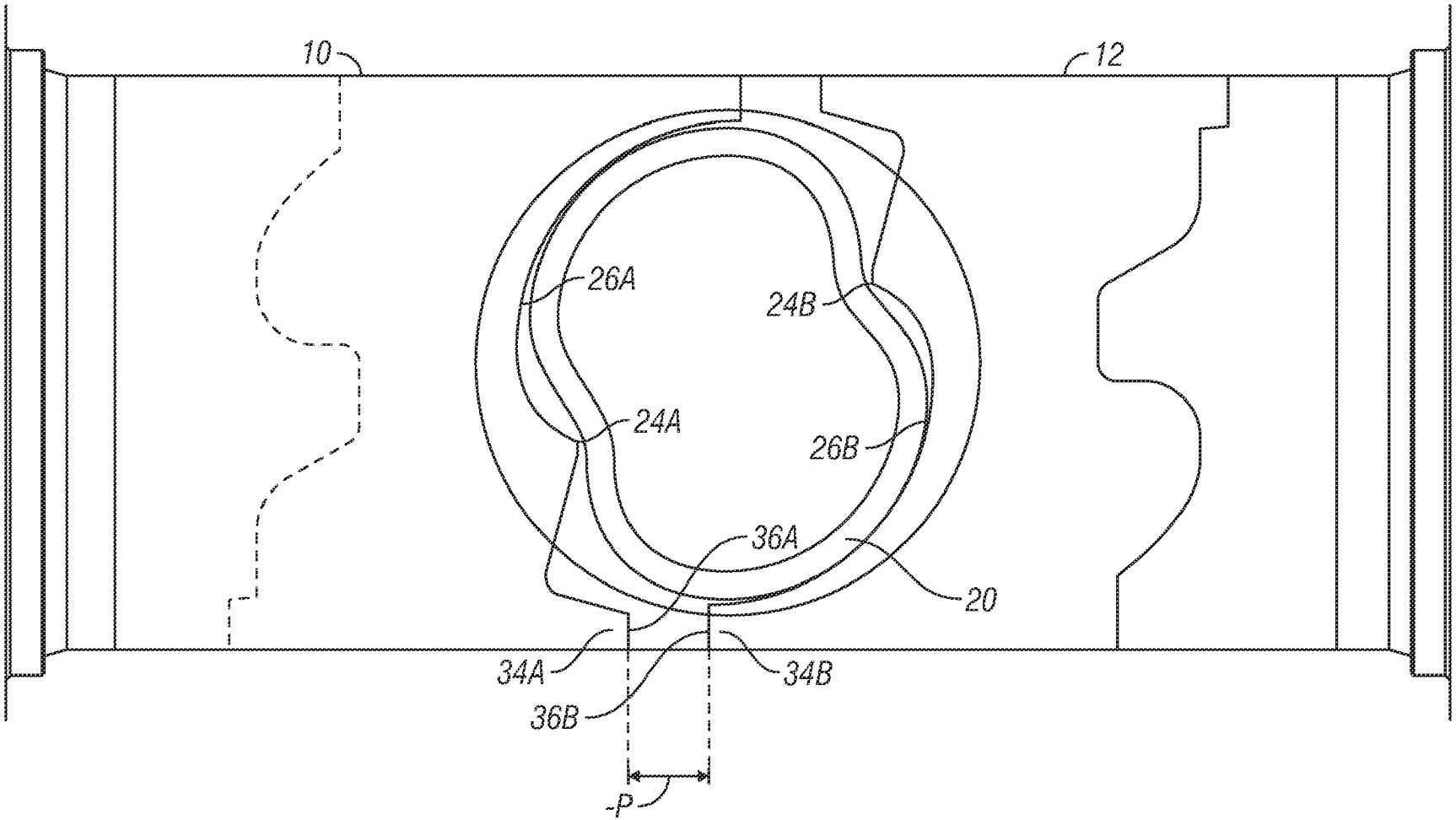
FIG. 9 is a schematic top cross-sectional view of a portion of the BOP in FIG. 1A, illustrating the rams closing and centering and deforming the tubular member with the shear blade profiles.

FIG. 9 is a schematic top cross-sectional view of a portion of the BOP in FIG. 1A, illustrating the rams closing and centering and deforming the tubular member with the shear blade profiles. As the rams continue to close, the stress concentrators 24A, 24B and the centering shaped surfaces 26A, 26B contact the tubular member 20. Continued closing causes the tubular member 20 to start to deform which exceeds the yield strength of the tubular member material but not the ultimate tensile strength, so that portions of the tubular member contact more completely other portions of the centering shaped surfaces 26A, 26B. In the illustrated embodiment with the particular size of the tubular member and the through-bore, the containment arms 34A, 34B do not overlap each other at this time in the process. Thus, the overlap distance P is still a negative value, but less negative than the distance shown in FIG. 8.

Figure 10:
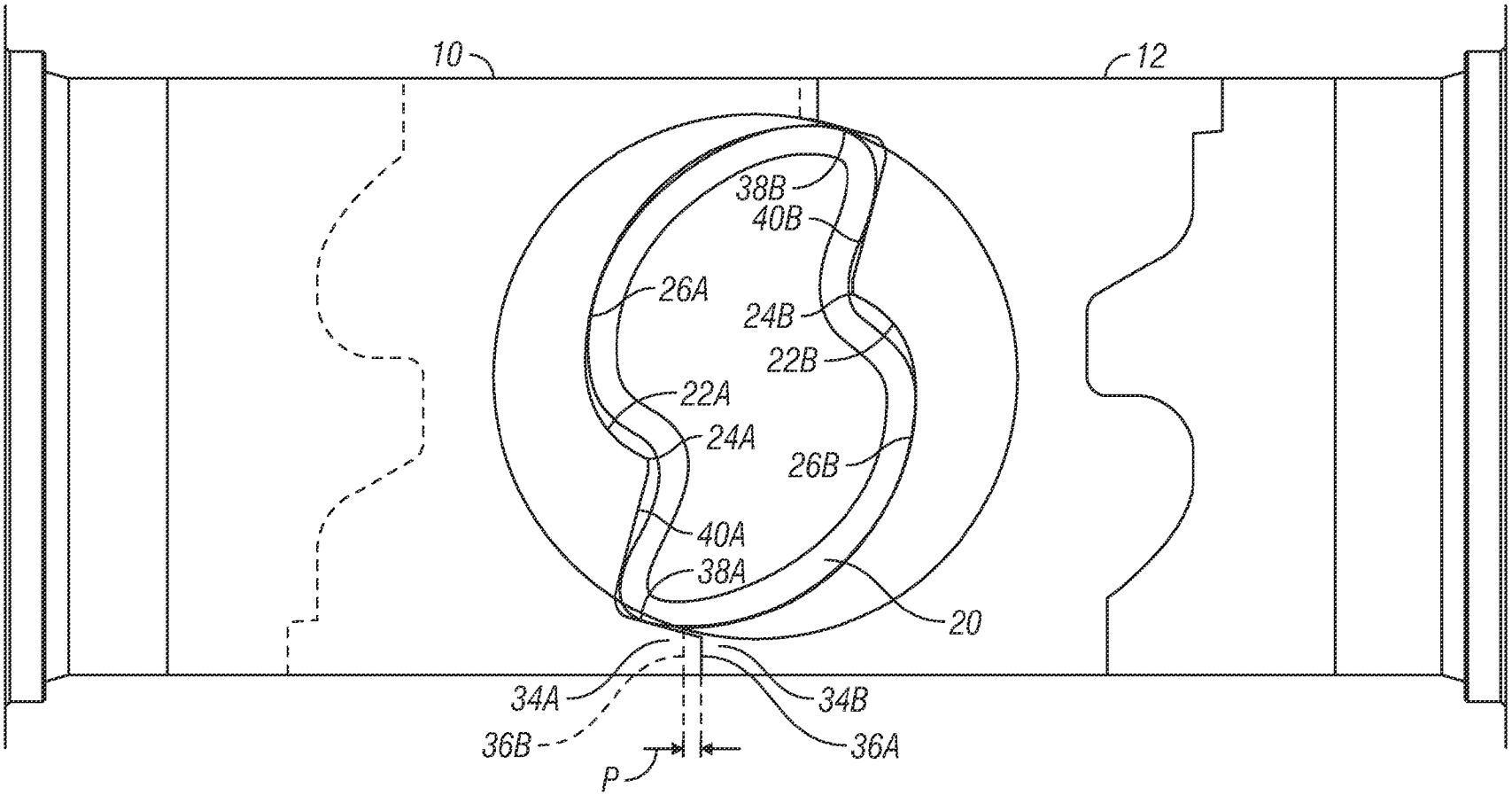
FIG. 10 is a schematic top cross-sectional view of a portion of the BOP in FIG. 1A, illustrating the rams closing, and further centering and deforming the tubular member with the shear blade profiles.

FIG. 10 is a schematic top cross-sectional view of a portion of the BOP in FIG. 1A, illustrating the rams closing, and further centering and deforming the tubular member with the shear blade profiles. As the rams 10, 12 continue to close, the tubular member starts to form an "S" shape in at least one embodiment using the stress concentrators 24A, 24B. More specifically, the tubular member starts to fold in on itself. A greater percentage of the tubular member perimeter contacts a greater percentage of the shear blade profiles 22A, 22B and their respective surfaces, 26A, 38A, 40B, 26B, 38B, 40B. Further, the containment arms 34A and 34B overlap each other by a positive value overlap distance P, and thus form a lateral boundary to the tubular member as it collapses through the continued deformation. The overlap restricts the tubular member from deforming into an area between the containment arms on opposing shear blades and causing the tubular member to become wedged therebetween without separation and difficult to retrieve.

Figure 11:
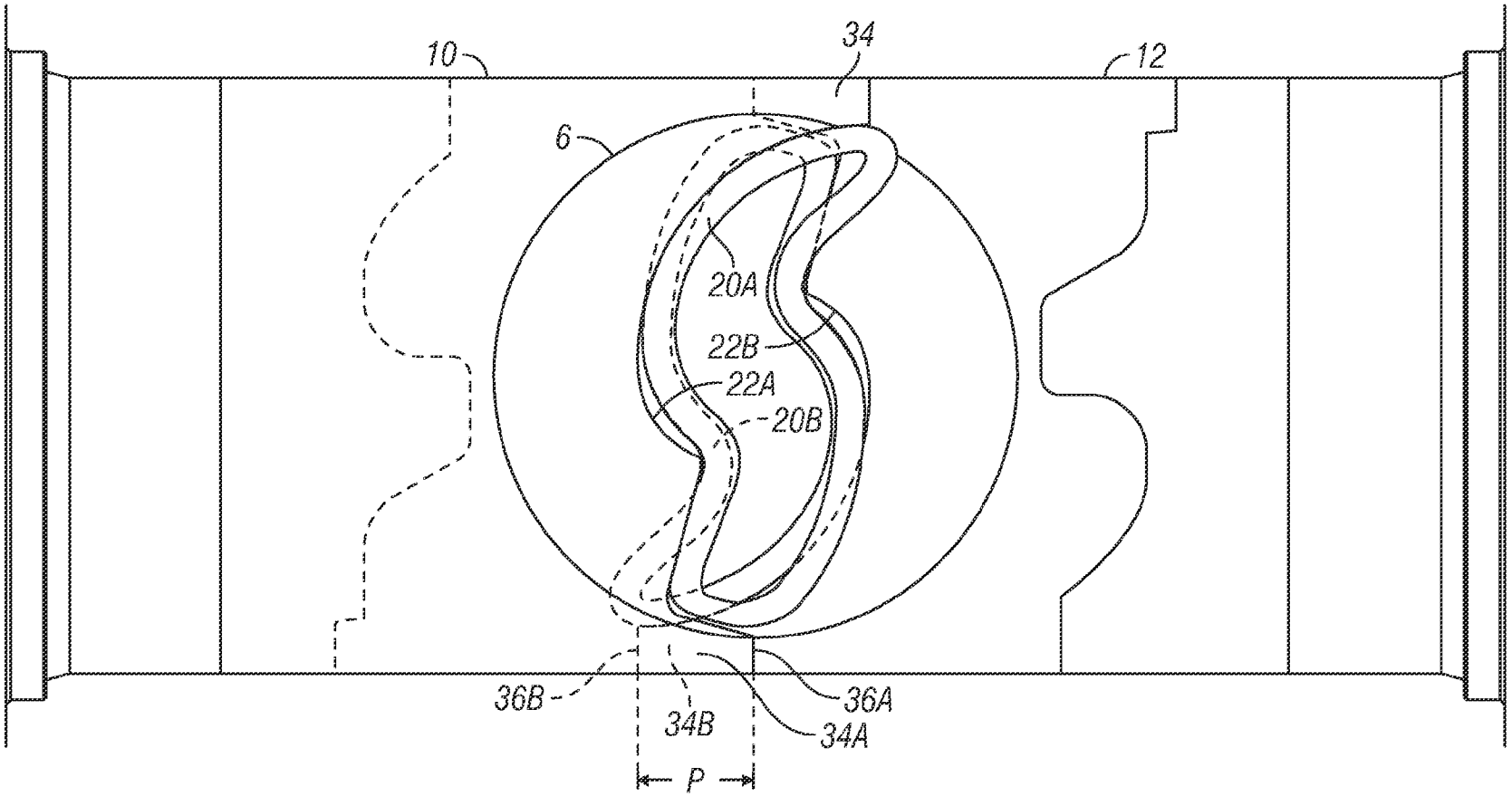
FIG. 11 is a schematic top cross-sectional view of a portion of the BOP in FIG. 1A, illustrating the rams closing, shearing, and further deforming the tubular member with the shear blade profiles.

FIG. 11 is a schematic top cross-sectional view of a portion of the BOP in FIG. 1A, illustrating the rams closing, shearing, and further deforming the tubular member with the shear blade profiles. As the rams close further, the shear blades start to separate the tubular member 20 into portions 20A, 20B by exceeding the shear strength, ultimate tensile strength, or a combination thereof. The overlap distance P increases to a greater positive value. The tubular member portions 20A, 20B are contained within the through-bore 6 by the containment arms 34A, 34B for each ram 10, 12 in a lateral direction and by the shear blade profiles 22 and mandrels described herein for each ram in the longitudinal direction.

While not intended to be limiting, it is believed that the shape of the shear face referenced in FIGS. 1B, 1C assist in separating the tubular member 20 by a combination of tearing and shearing, that is, exceeding the ultimate tensile strength for a portion of the separation process and exceeding the shear strength for another portion of the separation process, and a combination thereof. The ultimate tensile strength may be exceeded by the distance along the shear face that stretches the material in contact with the face with a longer length that the material initially had before it became trapped between the shear blades 21. It is also possible that other metallurgical mechanisms are involved, however, and thus the belief is only provided for general guidance as a potential explanation.

Figure 12:
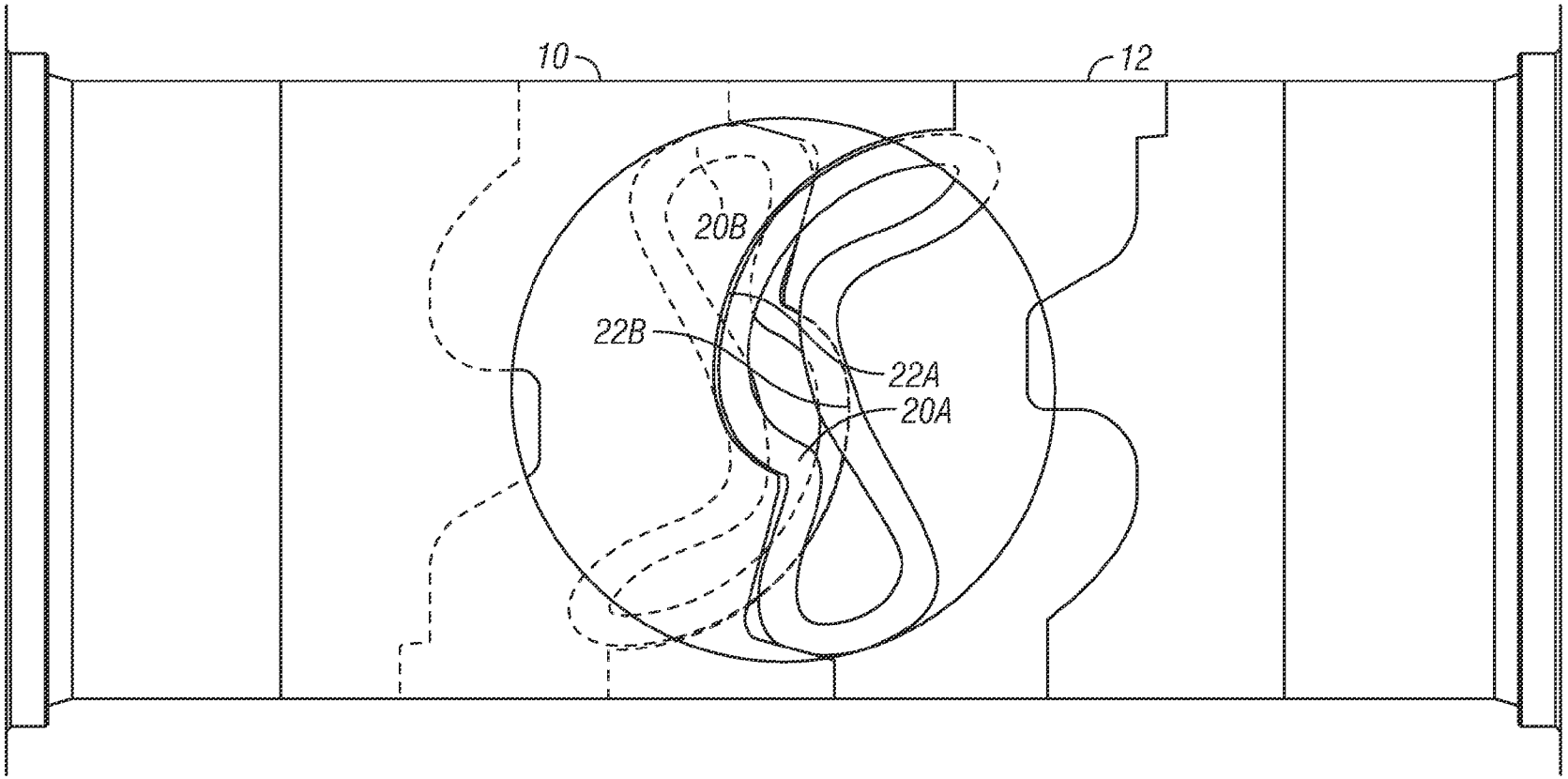
FIG. 12 is a schematic top cross-sectional view of a portion of the BOP in FIG. 1A, illustrating the rams closing, and further shearing and deforming the tubular member with the shear blade profiles.

FIG. 12 is a schematic top cross-sectional view of a portion of the BOP in FIG. 1A, illustrating the rams closing, and further shearing and deforming the tubular member with the shear blade profiles. As the rams close even further, the shearing continues, resulting in more displacement of the sheared tubular member portions 20A, 20B. The shear blade profiles 22*a*, 22*b* continue to reduce the depth of the tubular member in a longitudinal direction, but the width of the tubular member in a lateral direction is contained.

Figure 13:
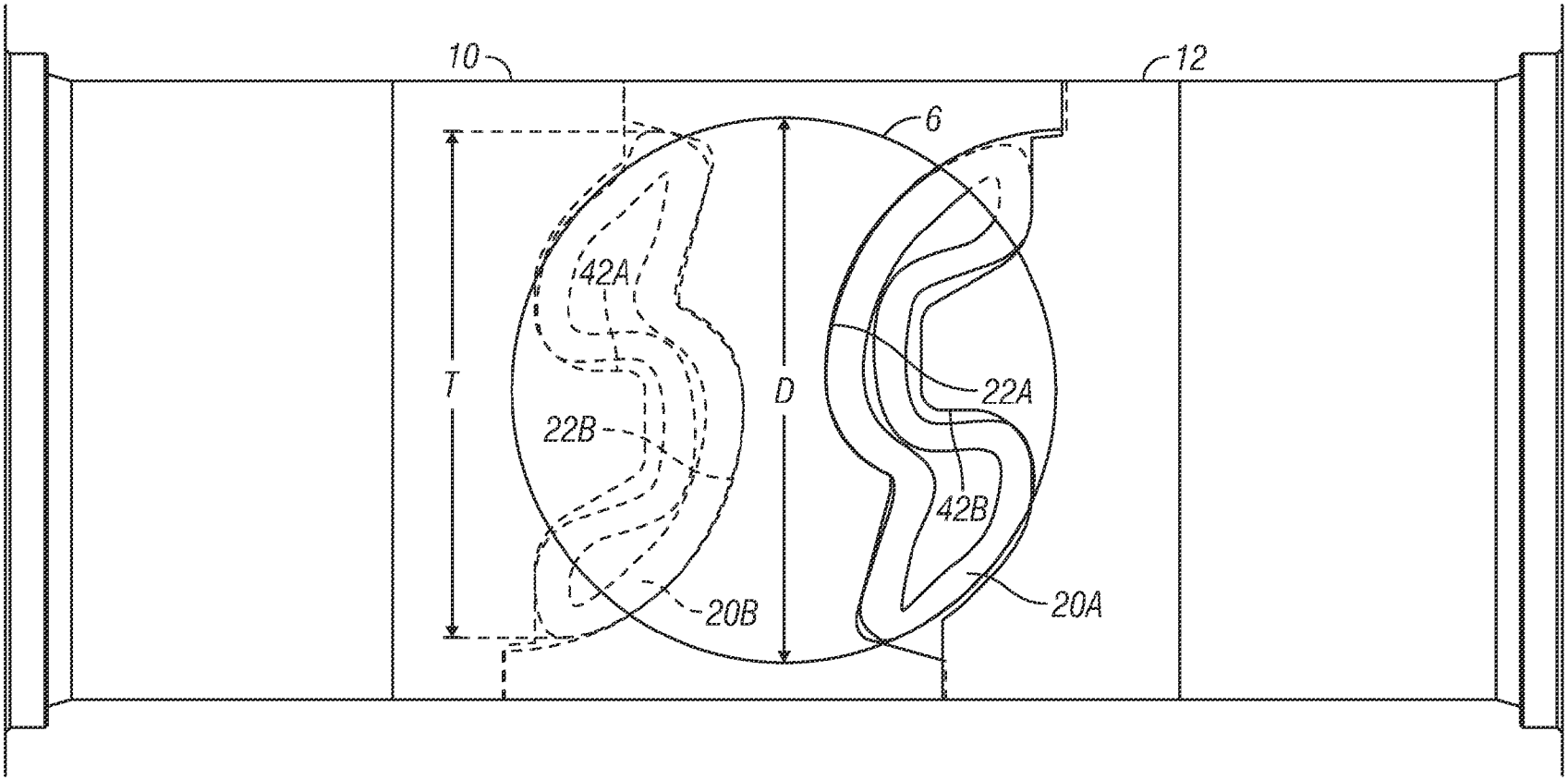
FIG. 13 is a schematic top cross-sectional view of a portion of the BOP in FIG. 1A, illustrating the rams closed, with the tubular member sheared in a final deformed condition with a mandrel and mandrel profile.

FIG. 13 is a schematic top cross-sectional view of a portion of the BOP in FIG. 1A, illustrating the rams closed, with the tubular member sheared in a final deformed condition. The rams 10, 12 move to their final closing position with the shear blades profiles 22A, 22B used to shear the tubular member 20 entirely and the tubular member 20, specifically the portions 20A, 20B, fully collapsed to the extent appropriate for the given application. The width "T" of the tubular member portions 20A, 20B has been constrained within the confines of the BOP through-bore 6. Specifically, the width "T" is equal to and advantageously less than the diameter "D" of the through-bore 6.

The mandrels 42A, 42B assist in supplying sufficient surface area for the tubular member 20, and specifically the portions 20A, 20B, to be deformed to such a width "W". The mandrels 42A, 42B have various surfaces of one type or another including a lead mandrel portion described above in FIG. 2 to provide increased surface area compared to just a simple straight line or even uniformly curved surface.

Thus, the shearing blade profile of the shear blades 22 and the mandrel profile of the mandrels 42 for the rams can interact to deform and collapse a significantly larger size tubular member 20 relative to the through-bore 6 compared to known current designs and still be able to retrieve the sheared tubular member through the through-bore of the BOP. The increase in allowable tubular member sizes that can be collapsed can be significant.

Figure 14:
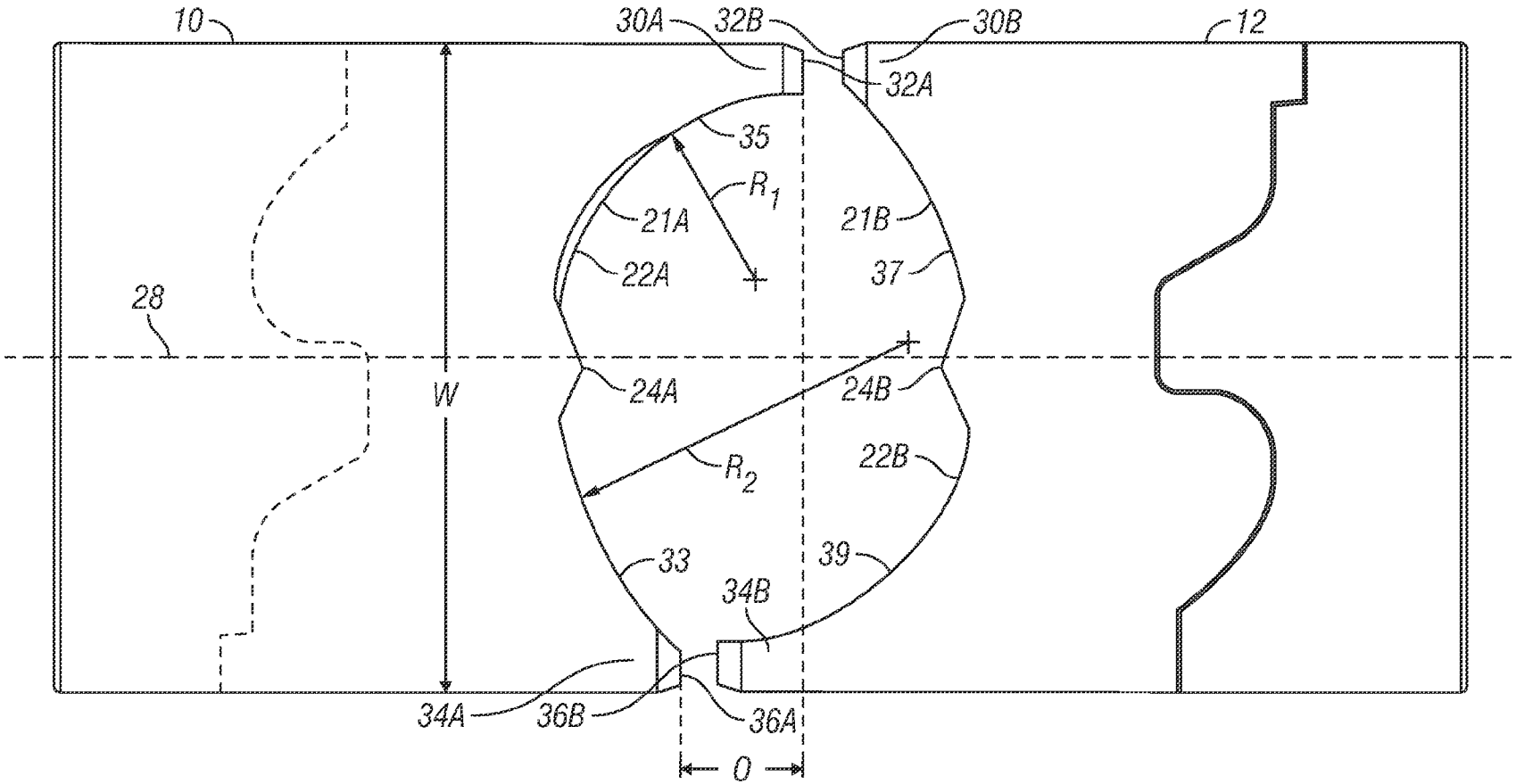
FIG. 14 is a schematic top cross-sectional view of a portion of the BOP in FIG. 1A, illustrating an exemplary shear blade having an alternative shear blade profile.

FIG. 14 is a schematic top cross-sectional view of a portion of the BOP in FIG. 1A, illustrating an exemplary shear blade having an alternative shear blade profile. The ram 10 includes a shear blade 21A having a shear blade profile 22A with a stress concentrator 24A. The stress concentrator 24A can be aligned along the centerline 28 or offset from the centerline. The exemplary shear blade profile 22A is generally formed with at least two curves with radii $R_1$ and $R_2$. In at least one embodiment, one or more of the radii is at least 20% of the width W of the ram 10. The ram 10 further includes a first containment arm 30A with an end 32A and a second containment arm 34A with an end 36A, where the containment arms are offset from each other by an offset distance O. The first portion 33 of the shear blade profile 22A is asymmetric with the second portion 35 of the shear blade profile 22A.

Similarly, the ram 12 includes a shear blade 21B having a shear blade profile 22B with a stress concentrator 24B. The stress concentrator 24B can be aligned along the centerline 28 or offset from the centerline. The exemplary shear blade profile 22B is generally formed with at least two curves with similar radii as profile 22A. The ram 12 further includes a first containment arm 30B with an end 32B and a second containment arm 34B with an end 36B, where the containment arms 30B, 34B are offset from each other by an offset distance that is the same or different than the offset distance from the containment arms 30A, 34A. The first portion 37 of the shear blade profile 22B is asymmetric with the second portion 39 of the shear blade profile 22B. The shear blade profile 22B can be similar to the profile 22A or an entirely different profile. Further, one or more stress concentrators 24A, 24B can be removed from the respective profiles 22A, 22B and would not have its stress concentrator. Other numbers of stress concentrators can be applied to the profiles 22A, 22B.

Figure 15:
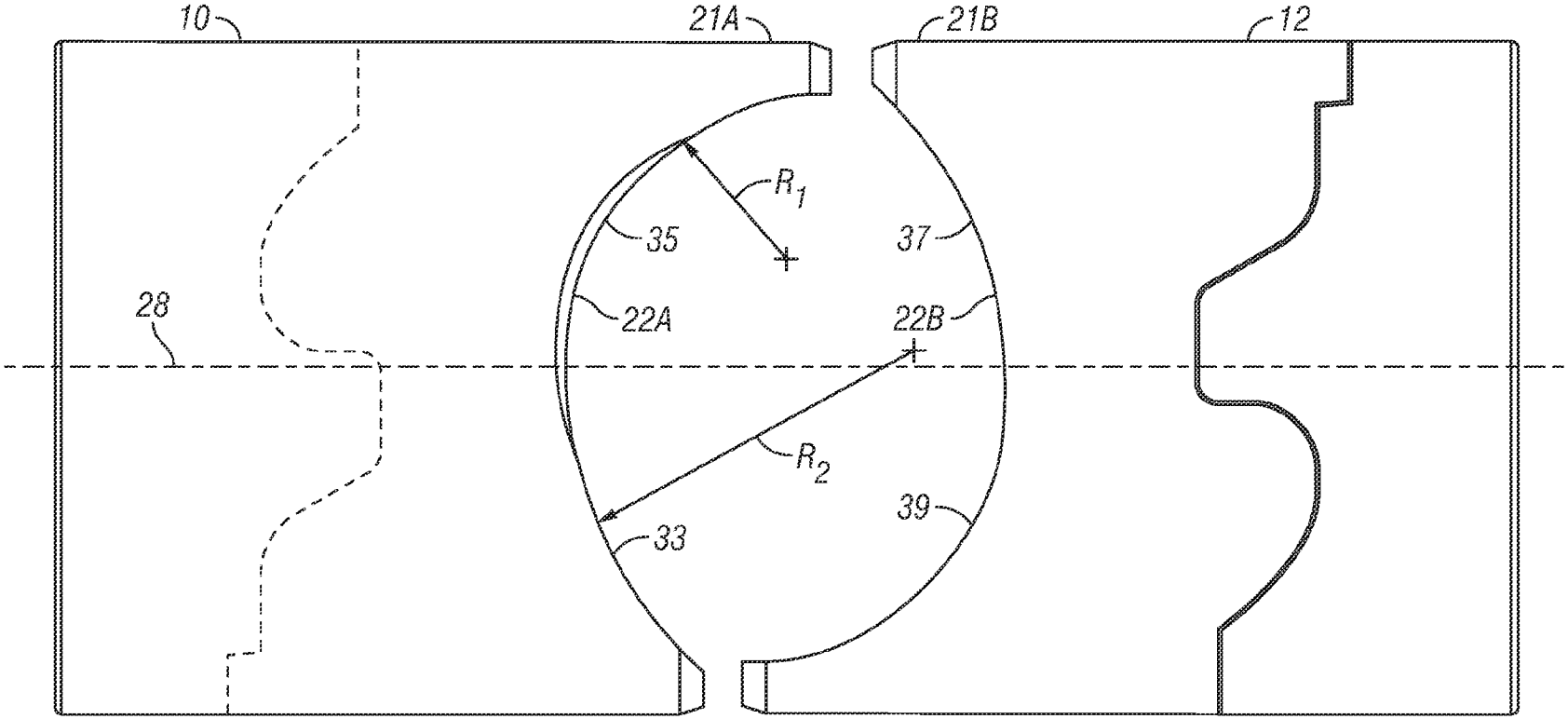
FIG. 15 is a schematic top cross-sectional view of a portion of the BOP in FIG. 1A, illustrating an exemplary shear blade having an alternative shear blade profile.

FIG. 15 is a schematic top cross-sectional view of a portion of the BOP in FIG. 1A, illustrating an exemplary shear blade having an alternative shear blade profile. The ram 10 includes a shear blade 21A having a shear blade profile 22A. The exemplary shear blade profile 22A is generally formed with at least two curves having radii $R_1$ and $R_2$. The first portion 33 of the shear blade profile 22A is asymmetric with the second portion 35 of the shear blade profile 22A.

Similarly, the ram 12 includes a shear blade 21B having a shear blade profile 22B. The exemplary shear blade profile 22B is generally formed with at least two curves with similar radii as for profile 22A. The first portion 37 of the shear blade profile 22B is asymmetric with the second portion 39 of the shear blade profile 22B. The shear blade profile 22B can be similar to the profile 22A or an entirely different profile.

Figure 16:
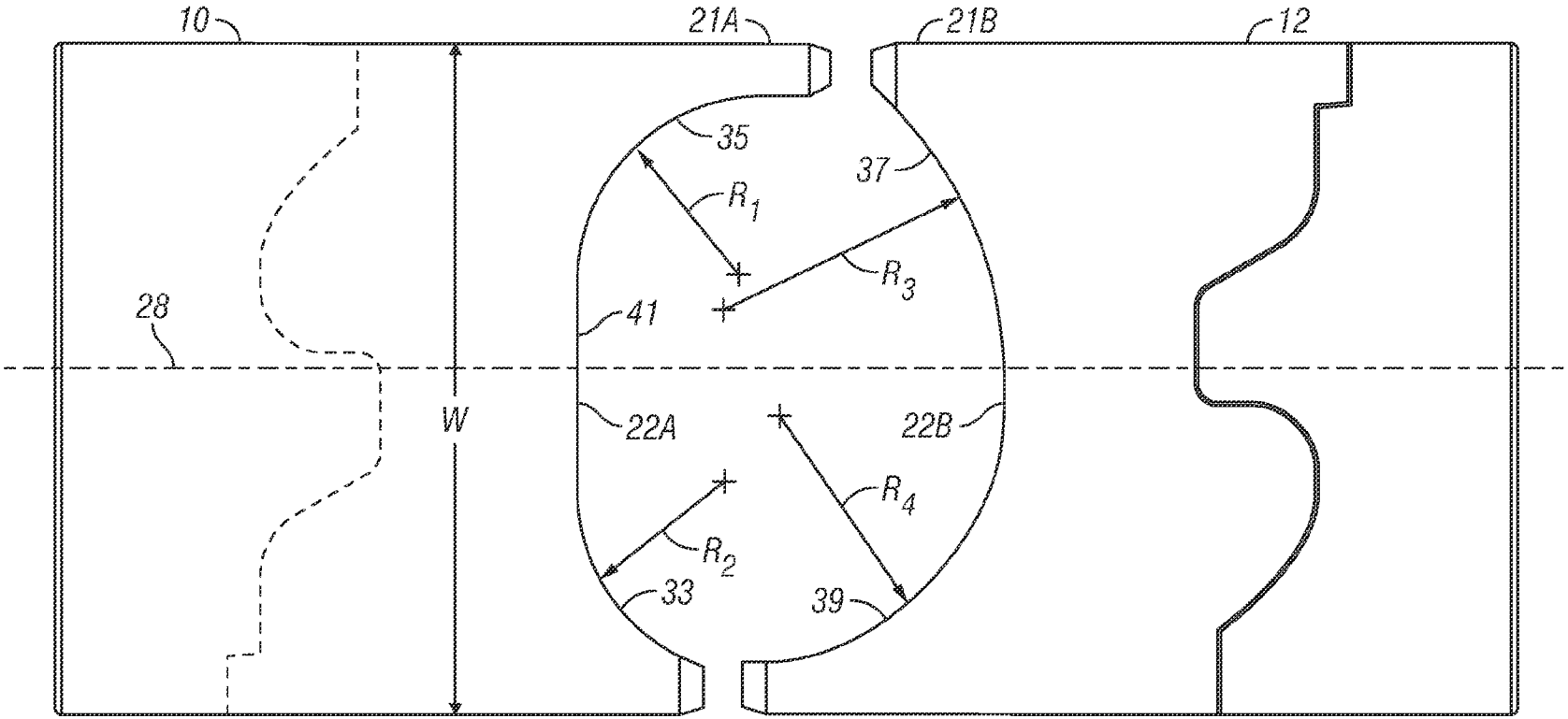
FIG. 16 is a schematic top cross-sectional view of a portion of the BOP in FIG. 1A, illustrating an exemplary shear blade having an alternative shear blade profile.

FIG. 16 is a schematic top cross-sectional view of a portion of the BOP in FIG. 1A, illustrating an exemplary shear blade having an alternative shear blade profile. The ram 10 includes a shear blade 21A having a shear blade profile 22A. The exemplary shear blade profile 22A is generally formed with at least two curves having a radius $R_1$ and radius $R_2$. In some embodiments, $R_1$ can equal $R_2$, so that the first portion 33 of the shear blade profile 22A can be symmetric with the second portion 35 of the shear blade profile 22A. A transition portion 41A can be formed between the curves in the profile 22A, depending on the size of the radius $R_1$.

The ram 12 includes a shear blade 21B having a shear blade profile 22B. The exemplary shear blade profile 22B is generally formed with at least two curves with radii $R_3$ and $R_4$. In at least one embodiment, one or more of the radii is at least 20% of the width W of the ram 12. The first portion 37 of the shear blade profile 22B is asymmetric with the second portion 39 of the shear blade profile 22B. Further, the shear blade profile 22B is different than the shear blade profile 22A. Other shapes of profiles can be used.

Figure 17:
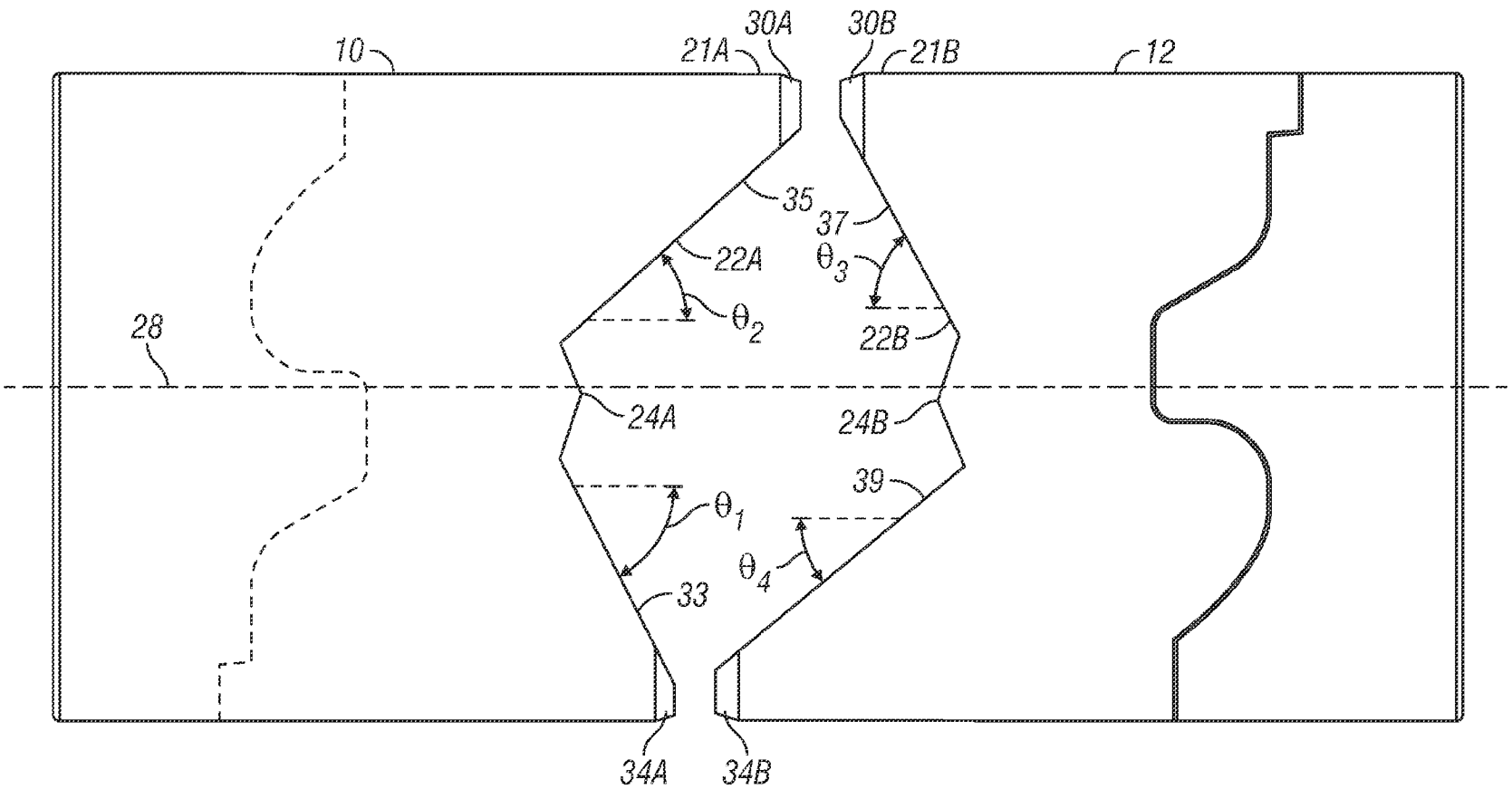
FIG. 17 is a schematic top cross-sectional view of a portion of the BOP in FIG. 1A, illustrating an exemplary shear blade having an alternative shear blade profile.

FIG. 17 is a schematic top cross-sectional view of a portion of the BOP in FIG. 1A, illustrating an exemplary shear blade having an alternative shear blade profile. The ram 10 includes a shear blade 21A having a shear blade profile 22A with a stress concentrator 24A. The stress concentrator 24A can be aligned along the centerline 28 or offset from the centerline. The exemplary shear blade profile 22A is generally formed with a relatively straight first portion 33 from the containment arm 34A to the stress concentrator 24A at a first engagement angle $\theta_1$ relative to the centerline 28, and a relatively straight second portion 35 from the containment arm 30A to the stress concentrator 24A at a second engagement angle $\theta_2$ relative to the centerline 28 that is different from the first engagement angle $\theta_1$. The containment arms can be offset from each other by an offset distance, as described above. The first portion 33 of the shear blade profile 22A is asymmetric with the second portion 35 of the shear blade profile 22A in that the portions 33, 35 are at least at different engagement angles.

The ram 12 includes a shear blade 21B having a shear blade profile 22B with a stress concentrator 24B. The stress concentrator 24B can be aligned along the centerline 28 or offset from the centerline. The exemplary shear blade profile 22B is generally formed with a relatively straight first portion 37 from the containment arm 30B to the stress concentrator 24B at a first engagement angle $\theta_3$ relative to the centerline 28, and a relatively straight second portion 39 from the containment arm 34B to the stress concentrator 24B at a second engagement angle $\theta_4$ relative to the centerline 28 that is different from the first engagement angle $\theta_3$. The containment arms can be offset from each other by an offset distance, as described above. The first portion 37 of the shear blade profile 22B is asymmetric with the second portion 39 of the shear blade profile 22B in that the portions 37, 39 are at least at different engagement angles. Further, the profile 22B can be the same or different than the profile 22A.

Figure 18:
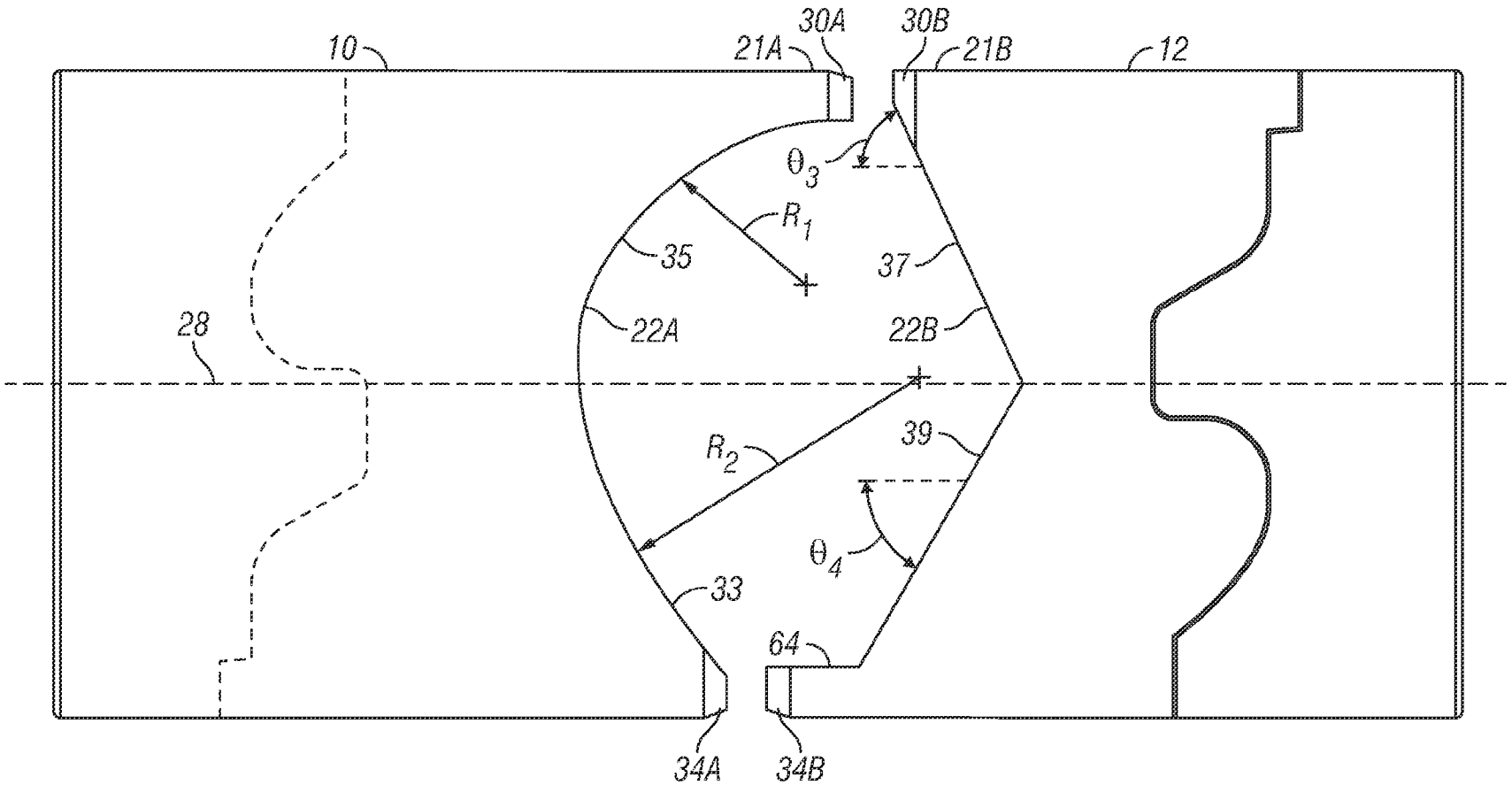
FIG. 18 is a schematic top cross-sectional view of a portion of the BOP in FIG. 1A, illustrating an exemplary shear blade having an alternative shear blade profile.

FIG. 18 is a schematic top cross-sectional view of a portion of the BOP in FIG. 1A, illustrating an exemplary shear blade having an alternative shear blade profile. The ram 10 includes a shear blade 21A having a shear blade profile 22A. The exemplary shear blade profile 22A is generally formed with at least two curves having radii $R_1$ and $R_2$. The first portion 33 of the shear blade profile 22A is asymmetric with the second portion 35 of the shear blade profile 22A.

The ram 12 includes a shear blade 21B having a shear blade profile 22B. The exemplary shear blade profile 22B is generally formed with a relatively straight first portion 37 from the containment arm 30B to the centerline 28 at a first engagement angle $\theta_3$ relative to the centerline, and a relatively straight second portion 39 from the containment arm 34B to the centerline 28 at a second engagement angle $\theta_4$ relative to the centerline, where the first and second engagement angles can be the same value. The first portion 37 of the shear blade profile 22B is symmetric with the second portion 39 of the shear blade profile 22B in that the portions 37, 39 are at least at the same engagement angles. The containment arms can be offset from each other by an offset distance, as described above. However, because the engagement angles are the same and therefore the portions 37, 39 intersect their respective containment arms 30B, 34B at different points due to the offset, an extension 64 can be created on the longer containment arm, that is, on containment arm 34B in this example.

Figure 19:
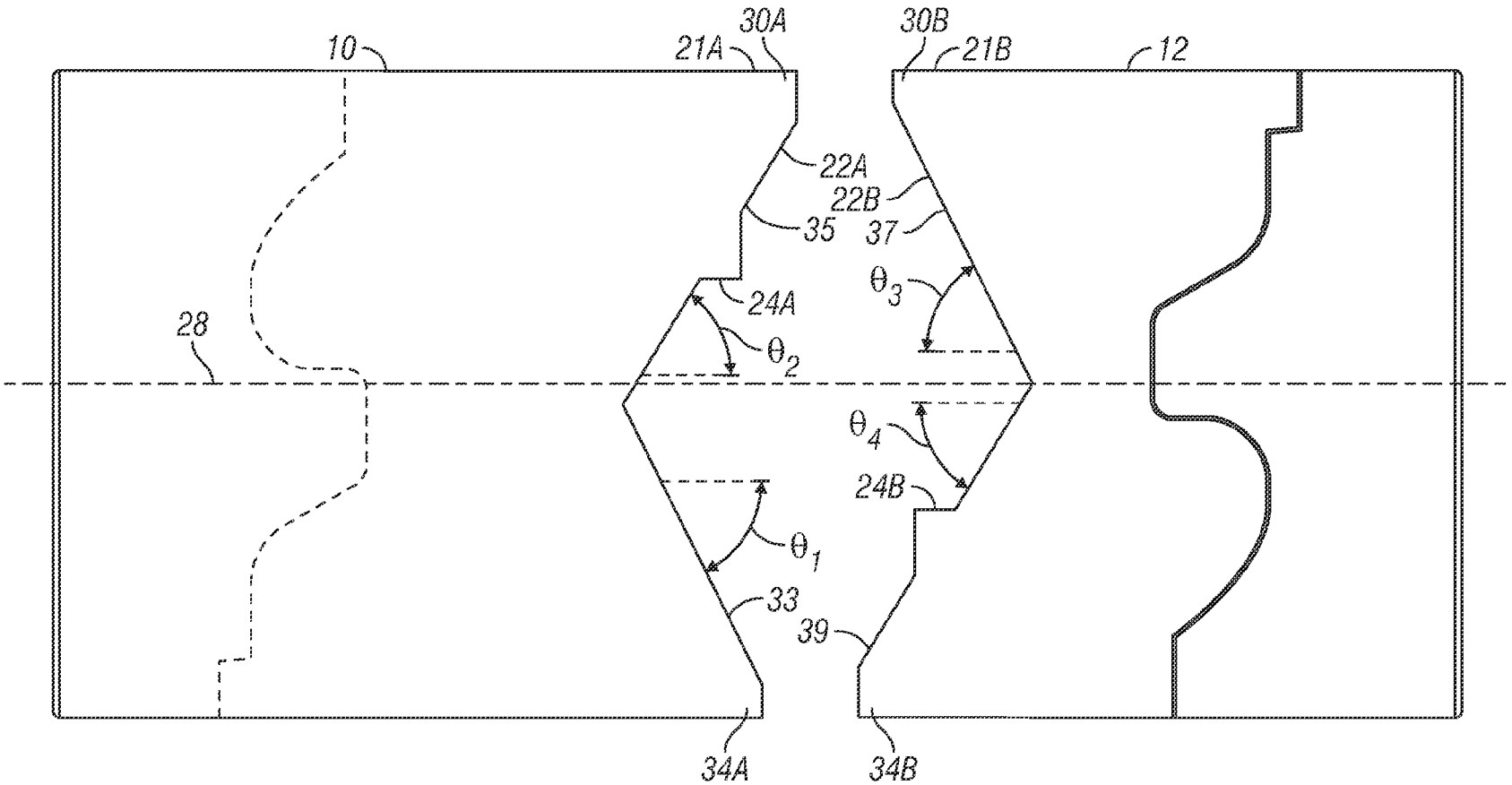
FIG. 19 is a schematic top cross-sectional view of a portion of the BOP in FIG. 1A, illustrating an exemplary shear blade having an alternative shear blade profile.

FIG. 19 is a schematic top cross-sectional view of a portion of the BOP in FIG. 1A, illustrating an exemplary shear blade having an alternative shear blade profile. The ram 10 includes a shear blade 21A having a shear blade profile 22A with a stress concentrator 24A. The stress concentrator 24A is laterally offset from the centerline 28 and in the second portion 35 of the profile 22A. More specifically, the exemplary shear blade profile 22A is generally formed with a relatively straight first portion 33 from the containment arm 34A to the centerline 28 at a first engagement angle $\theta_1$ relative to the centerline 28, and a relatively straight second portion 35 from the containment arm 30A to the centerline 28 at a second engagement angle $\theta_2$ with a discontinuity caused by the interruption of the stress concentrator 24A. The second engagement angle $\theta_2$ can be the same value as the first engagement angle $\theta_1$. The containment arms 30A, 34A can optionally not be offset from each other, as has been described above for other exemplary embodiments. The first portion 33 of the shear blade profile 22A is asymmetric on a first side of the centerline 28 with the second portion 35 of the shear blade profile 22A on a second side of the centerline 28 in that the portion 35 at least includes the stress concentrator 24A, which is different from the portion 33.

The ram 12 includes a shear blade 21B having a shear blade profile 22B with a stress concentrator 24B. The stress concentrator 24B is laterally offset from the centerline 28 and in the second portion 39 of the profile 22B. More specifically, the exemplary shear blade profile 22B is generally formed with a relatively straight first portion 37 from the containment arm 30B to the centerline 28 at a first engagement angle $\theta_3$ relative to the centerline 28, and a relatively straight second portion 39 from the containment arm 34B to the centerline 28 at a second engagement angle $\theta_4$ with a discontinuity caused by the interruption of the stress concentrator 24B. The second engagement angle $\theta_4$ can be the same value as the first engagement angle $\theta_3$. The containment arms 30B, 34B can optionally not be offset from each other, as has been described above for other exemplary embodiments. The first portion 37 of the shear blade profile 22B is asymmetric on the second side of the centerline 28 with the second portion 39 of the shear blade profile 22B on the first side of the centerline 28 in that the portion 39 at least includes the stress concentrator 24B, which is different from the portion 37. The profiles 22A, 22B can include various numbers of stress concentrators, from zero to many, as long as the portions 33, 35 and portions 37, 39 on different sides of the centerline 28 are asymmetric. Further, the profile 22B can be the same or different than the profile 22A.

As has been described in the examples above, the term "asymmetric" in meant to include a difference between a portion of the shear blade profile on one side of the centerline 28 compared to a portion of the shear blade profile on the other side of the centerline 28, including but not limited to, different structures such as different shaped stress concentrators or the number of stress concentrators from zero to many, different shaped surfaces on the respective portions, different engagement angles of the portions, different lengths of shapes surfaces on the portions, and other differences.

Other and further embodiments utilizing one or more aspects of the inventions described above can be devised without departing from the spirit of the disclosed invention. For example and without limitation, the shapes of the shear blade profile and mandrel profile can be altered to accomplish centering, deforming, or tearing or shearing, or a combination thereof. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

The invention claimed is:

1. A blowout preventer ("BOP") for an oil or gas well, comprising:

a BOP body having a through-bore defining a centerline and adapted to allow a tubular member to be disposed therethrough, the body having at least a first guideway defining a guideway centerline formed at an angle to the through-bore centerline;

a first ram slidably coupled to the BOP body along the first guideway for travel along the first guideway;

a first shear blade coupled to the first ram toward the through-bore to shear a tubular member disposed therein, the first shear blade being disposed laterally across the first ram and having a first shear blade profile with a first portion on one side of the guideway centerline and a second portion on an opposite side of the guideway centerline from the first portion, the first portion and the second portion of the first shear blade profile being asymmetric from each other relative to the guideway centerline;

a second ram slidably coupled to the BOP body along a second guideway aligned with the first guideway; and a second shear blade coupled to the second ram and distal from the first shear blade relative to the through-bore, the second shear blade being disposed laterally across the second ram and having a second shear blade profile with a first portion on one side of the guideway centerline and a second portion on an opposite side of the guideway centerline, the first portion and the second portion of the second shear blade profile being asymmetric from each other relative to the guideway centerline;

wherein the first shear blade profile is configured to move the tubular member positioned on a first side laterally of the guideway centerline toward the guideway centerline; and wherein the second shear blade profile is configured to move the tubular member positioned on a second side laterally of the guideway centerline toward the guideway centerline;

wherein the first shear blade profile defines a first centering profile adapted to push the tubular member toward the centerline of the through-bore; and wherein the second shear blade profile defines a second centering profile adapted to push a tubular member toward the centerline of the through-bore;

wherein the first centering profile comprises a first curved profile;

wherein the first shear blade profile comprises a first stress concentrator;

wherein the first stress concentrator is laterally offset from the guideway centerline; and wherein the first stress concentrator is on the opposite side laterally of the guideway centerline from a majority of the curved profile.

2. The BOP of claim 1, wherein the first shear blade profile comprises a first linear profile adjacent the first stress concentrator; and wherein the first linear profile is on the opposite side of the first stress concentrator from the first curved profile.

3. The BOP of claim 2, wherein the first ram comprises a first containment arm and a second containment arm, each arm laterally disposed distally from the guideway centerline and extended toward the through-bore, the containment arms being offset from each other longitudinally along the guideway centerline so that the first containment arm is longer than the second containment arm.

4. The BOP of claim 3, wherein the first curved profile intersects the first containment arm.

5. The BOP of claim 1, wherein the first and second rams each comprise a first containment arm and a second containment arm, each arm laterally disposed distally from the guideway centerline and extended toward the through-bore, the containment arms being sized to overlap each other longitudinally along the guideway centerline as the containment arms are closed toward each other relative to the through-bore and prior to shearing a tubular member disposed in the through-bore.

6. A blowout preventer ("BOP") for an oil or gas well, comprising:

a BOP body having a through-bore defining a centerline and adapted to allow a tubular member to be disposed therethrough, the body having at least a first guideway defining a guideway centerline formed at an angle to the through-bore centerline;

a first ram slidably coupled to the BOP body along the first guideway for travel along the first guideway;

a first shear blade coupled to the first ram toward the through-bore to shear the tubular member disposed therein, the first shear blade being disposed laterally across the first ram and having a first shear blade profile being asymmetric relative to the guideway centerline, wherein the first shear blade profile comprises a first profile curved portion that is asymmetric relative to the guideway centerline and is adjacent to a first stress concentrator;

a second ram slidably coupled to the BOP body along a second guideway aligned with the first guideway; and a second shear blade coupled to the second ram and distal from the first shear blade relative to the through-bore, the second shear blade being disposed laterally across the second ram and having a second shear blade profile being asymmetric relative to the guideway centerline, wherein the second shear blade profile comprises a second curved portion that is asymmetric relative to the guideway centerline and is adjacent to a second stress concentrator; wherein the second stress concentrator is reversed to the orientation of the first stress concentrator relative to the guideway centerline; and wherein the second curved portion is reversed to the orientation of the first curved portion relative to the guideway centerline;

wherein the first shear blade profile and second blade profile are configured to move the tubular member positioned anywhere in the through-bore to the guideway centerline.

7. The BOP of claim 6, wherein the first shear blade profile is a mirror image of the second shear blade profile.

8. The BOP of claim 6, wherein the first shear blade profile is configured to move the tubular member positioned on a first side laterally of the guideway centerline toward the guideway centerline; and wherein the second shear blade profile is configured to move a tubular member positioned on a second side laterally of the guideway centerline toward the guideway centerline.

9. The BOP of claim 6, wherein the first shear blade profile contains a first linear portion; and wherein the second shear blade profile contains a second linear portion.

10. The BOP of claim 9, wherein the first stress concentrator is located between the first curved portion and the first linear portion of the first shear blade profile; and wherein the second stress concentrator is located between the second curved portion and the second linear portion of the second shear blade profile.

11. The BOP of claim 6, wherein the first ram comprises a first ram first containment arm and a first ram second containment arm, each arm is laterally disposed distally from the guideway centerline and extended toward the through-bore, the first ram first and second containment arms being offset from each other longitudinally along the guideway centerline so that the first ram first containment arm is longer than the first ram second containment arm; and wherein the second ram comprises a second ram first containment arm and a second ram second containment arm, each arm is laterally disposed distally from the guideway centerline and extended toward the through-bore, the second ram first and second containment arms being offset from each other longitudinally along the guideway centerline so that the second ram first containment arm is longer than the second ram second containment arm.

12. The BOP of claim 11, wherein the first curved profile intersects the first ram first containment arm; and wherein the second curved profile intersects the second ram second containment arm.

13. The BOP of claim 6, wherein the first shear blade profile comprises a first shear face having a rake angle perpendicular to the guideway centerline.

14. A blowout preventer ("BOP") for an oil or gas well, comprising:

a BOP body having a through-bore defining a centerline and adapted to allow a tubular member to be disposed therethrough, the body having at least a first guideway defining a guideway centerline formed at an angle to the through-bore centerline;

a first ram slidably coupled to the BOP body along the first guideway for travel along the first guideway;

a first shear blade coupled to the first ram toward the through-bore to shear the tubular member disposed therein, the first shear blade being disposed laterally across the first ram and having a first shear blade profile being asymmetric about the guideway centerline, wherein the first shear blade profile comprises a first profile curved portion that is asymmetric about the guideway centerline and is adjacent to a first profile stress concentrator;

a second ram slidably coupled to the BOP body along a second guideway aligned with the first guideway; and a second shear blade coupled to the second ram and distal from the first shear blade relative to the through-bore, the second shear blade being disposed laterally across the second ram and having a second shear blade profile being asymmetric about the guideway centerline, wherein the second shear blade profile comprises a second profile curved portion that is asymmetric about the guideway centerline and is adjacent to a second profile stress concentrator; wherein the second profile stress concentrator is reversed to the orientation of the first profile stress concentrator relative to the guideway centerline, and wherein the second profile curved portion is reversed to the orientation of the first profile curved portion relative to the guideway centerline;

wherein the first shear blade profile is configured to move the tubular member positioned on a first side of the guideway centerline toward the guideway centerline; and wherein the second shear blade profile is configured to move the tubular member positioned on a second side of the guideway centerline toward the guideway centerline, wherein the first shear blade profile and second blade profile are configured to move the tubular member positioned anywhere in the through-bore to the guideway centerline.

15. The BOP of claim 14, wherein the first ram comprises a first containment arm and a second containment arm, each arm laterally disposed distally from the guideway centerline and extended toward the through-bore, the containment arms being offset from each other longitudinally along the guideway centerline; and wherein the containment arms being sized to overlap each other longitudinally along the guideway centerline as the containment arms are closed toward each other relative to the through-bore and prior to shearing a tubular member disposed in the through-bore.

16. A blowout preventer ("BOP") for an oil or gas well, comprising:

a BOP body having a through-bore defining a centerline and adapted to allow a tubular member to be disposed therethrough, the body having at least a first guideway defining a guideway centerline formed at an angle to the through-bore centerline;

a first ram slidably coupled to the BOP body along the first guideway for travel along the first guideway;

a first shear blade coupled to the first ram toward the through-bore to shear the tubular member disposed therein, the first shear blade being disposed laterally across the first ram and having a first shear blade profile being asymmetric about the guideway centerline;

a second ram slidably coupled to the BOP body along a second guideway aligned with the first guideway; and a second shear blade coupled to the second ram and distal from the first shear blade relative to the through-bore, the second shear blade being disposed laterally across the second ram and having a second shear blade profile being asymmetric about the guideway centerline;

wherein the first shear blade profile is configured to move the tubular member positioned on a first side of the guideway centerline toward the guideway centerline; and wherein the second shear blade profile is configured to move the tubular member positioned on a second side of the guideway centerline toward the guideway centerline;

wherein the first shear blade profile is a mirror image of the second shear blade profile, wherein the first shear blade profile and second blade profile are configured to move the tubular member positioned anywhere in the through-bore to the guideway centerline, wherein the first shear blade profile and the second shear blade profile each contain a curved portion that is asymmetric about the guideway centerline;

wherein the first shear blade profile and the second shear blade profile each contain a linear portion; and wherein there is a first stress concentrator between the curved portion and the linear portion of the first shear blade profile and a second stress concentrator between the curved portion and the linear portion of the second shear blade profile.

* * * * *